US011523226B2

(12) United States Patent
Antonsen et al.

(10) Patent No.: US 11,523,226 B2
(45) Date of Patent: Dec. 6, 2022

(54) SYSTEMS AND METHODS FOR CONFIGURING HEARING DEVICES

(71) Applicant: GN Hearing A/S, Ballerup (DK)

(72) Inventors: Frank Antonsen, Copenhagen (DK); David Landwehr, Hvidovre (DK)

(73) Assignee: GN HEARING A/S, Ballerup (DK)

( * ) Notice: Subject to any disclaimer, the term of this patent is extended or adjusted under 35 U.S.C. 154(b) by 118 days.

(21) Appl. No.: 17/169,453

(22) Filed: Feb. 6, 2021

(65) Prior Publication Data

US 2022/0256293 A1 Aug. 11, 2022

(51) Int. Cl.
*H04R 25/00* (2006.01)

(52) U.S. Cl.
CPC ..... *H04R 25/30* (2013.01); *H04R 25/505* (2013.01); *H04R 25/554* (2013.01); *H04R 2225/55* (2013.01)

(58) Field of Classification Search
CPC .... H04R 25/30; H04R 25/505; H04R 25/554; H04R 2225/55
USPC ..... 381/315
See application file for complete search history.

(56) References Cited

U.S. PATENT DOCUMENTS

2018/0242090 A1* 8/2018 Sigwanz ..... H04R 25/70
2021/0329393 A1* 10/2021 Swetlitz ..... H04R 25/70

* cited by examiner

*Primary Examiner* — Phylesha Dabney
(74) *Attorney, Agent, or Firm* — Vista IP Law Group, LLP

(57) ABSTRACT

An electronic device includes: an input configured to electronically obtain first information relating to a request for establishing communication between a fitting device and an end user device, the end user device being configured to configure a hearing device based on fitting data from the fitting device; and a processing unit configured to electronically process the first information, and provide second information for transmission to an AV provider; wherein the processing unit is also configured to obtain a connection information associated with a virtual fitting room from the AV provider, and provide the connection information associated with the virtual fitting room for the fitting device; and wherein the processing unit is also configured to provide the connection information associated with the virtual fitting room for transmission to the end user device.

26 Claims, 11 Drawing Sheets

SYSTEMS AND METHODS FOR CONFIGURING HEARING DEVICES

FIELD

The field relates to hearing devices, and more particularly, to systems and methods for configuring hearing devices, such as systems and method for fitting hearing aids.

BACKGROUND

Hearing aids are configured to compensate for hearing loss of users. Before a user can use a hearing aid, the user generally needs to go through a fitting process to fit the hearing aid so that the hearing compensation provided by the hearing aid will address the hearing deficiency of the particular user.

Fitting of a hearing aid may occur in a health care provider's office. For example, to fit a hearing aid, the user of the hearing aid needs to visit an audiologist's office. At the office, the audiologist will perform hearing tests on the user to determine the type and degree of hearing deficiency suffered by the user. Based on the results of the hearing tests, the audiologist may then configure the hearing aid so that its functionalities are specific for the particular user.

The subject disclosure is directed to systems and methods for configuring hearing devices (such as hearing aids), so that the user is not required to physically visit a health care provider's office in order to have his/her hearing device being fitted.

SUMMARY

An electronic device includes: an input configured to electronically obtain first information relating to a request for establishing communication between a fitting device and an end user device, the end user device being configured to configure a hearing device based on fitting data from the fitting device; and a processing unit configured to electronically process the first information, and provide second information for transmission to an AV provider; wherein the processing unit is also configured to obtain a connection information associated with a virtual fitting room from the AV provider, and provide the connection information associated with the virtual fitting room for the fitting device; and wherein the processing unit is also configured to provide the connection information associated with the virtual fitting room for transmission to the end user device.

Optionally, the connection information associated with the virtual fitting room is configured to allow the fitting device and the end user device to communicatively connect with each other.

Optionally, the first information comprises a request for the connection information, a request to set up a virtual meeting, a request for a session, a request for handshake, or a request that will lead to an establishment of a communication bridge between the fitting device and the end user device.

Optionally, the second information comprises a request for the connection information, a request to set up a virtual meeting, a request for a session, a request for handshake, or a request that will lead to an establishment of a communication bridge between the fitting device and the end user device.

Optionally, the second information is the same as the first information.

Optionally, the connection information comprises a virtual fitting room identification.

Optionally, the processing unit is also configured to obtain a first caller identification for the fitting device and a second caller identification for the end user device.

Optionally, the processing unit is also configured to provide the first caller identification for transmission to the fitting device, and to provide the second caller identification for transmission to the end user device.

Optionally, the electronic device comprises a server that is configured to communicate with the fitting device, the AV provider, and a notification server that is configured to provide VoIP message for the end user device.

An end user device includes: a first communication device configured to receive a connection information; a processing unit configured to operate the first communication device to communicatively connect the end user device with a fitting device through a virtual fitting room based on the connection information; and a user input component coupled to the processing unit, wherein the user input component is configured to receive a user input; wherein the processing unit is also configured to electronically obtain fitting data from the fitting device, and wherein the end user device is configured to configure a hearing device based on the fitting data.

Optionally, the end user device further includes a second communication device configured to communicate with the hearing device, wherein the processing unit is configured to configure the hearing device via the second communication device.

Optionally, the end user device is configured to receive data from the fitting device via a chat channel of the virtual fitting room.

Optionally, the processing unit comprises an interpreter; and wherein the processing unit is configured to electronically obtain the data from the fitting device via the chat channel, and wherein the interpreter is configured to determine whether the data is fitting data.

Optionally, the end user device is configured to configure the hearing device based on the fitting data by transmitting the fitting data to the hearing device.

Optionally, the connection information comprises a virtual fitting room identification, and wherein the end user device is also configured to obtain a caller identification associated with the end user device, and wherein the processing unit is configured to operate the first communication device to communicatively connect the end user device with the fitting device through the virtual fitting room based on both the virtual fitting room identification and the caller identification.

Optionally, the end user device is configured to receive the connection information from a notification server.

Optionally, the connection information is a part of a VoIP message provided by the notification server.

Optionally, the fitting data comprises hearing aid fitting data.

Optionally, the end user device comprises a cellular phone, a tablet, a computer, a laptop, a handheld device, or a remote control.

A fitting device includes: a user input component configured to obtain a user input; and a processing unit configured to electronically generate first information based on the user input, and to provide the first information for transmission to an electronic device, the first information relating to a request for establishing communication between the fitting device and an end user device, the end user device being configured to configure a hearing device; wherein the processing unit is also configured to obtain a connection information associated with a virtual fitting room from the electronic device; and wherein the fitting device is configured to communicatively connect with the virtual fitting room based on the connection information, and to communicate with the end user device via the virtual fitting room.

Optionally, the fitting device is configured to communicate with the end user device via a chat channel of the virtual fitting room.

Optionally, the processing unit is configured to provide fitting data for transmission to the end user device via the chat channel.

Optionally, the fitting data comprises hearing aid fitting data.

Optionally, the processing unit is also configured to generate a control signal for transmission via the chat channel, wherein the control signal is configured to cause the end user device to configure the hearing device.

Optionally, the connection information comprises a virtual fitting room identification, and wherein the fitting device is configured to obtain a caller identification associated with the fitting device, and wherein the processing unit is configured to operate the communication device to communicatively connect the fitting device with the end user device through the virtual fitting room based on both the virtual fitting room identification and the caller identification.

A hearing system includes: an electronic device; a fitting device; and an end user device, wherein the end user device is configured to configure a hearing device; (1) wherein the electronic device comprises: an input configured to electronically obtain first information relating to a request for establishing communication between the fitting device and the end user device, the end user device being configured to configure the hearing device based on fitting data from the fitting device; and a first processing unit configured to electronically process the first information, and provide second information for transmission to an AV provider; wherein the first processing unit is also configured to obtain a connection information associated with a virtual fitting room from the AV provider, and provide the connection information associated with the virtual fitting room for the fitting device; and wherein the first processing unit is also configured to provide the connection information associated with the virtual fitting room for transmission to the end user device; (2) wherein the end user device comprises: a communication device configured to receive the connection information; a second processing unit configured to operate the communication device to communicatively connect the end user device with the fitting device through the virtual fitting room based on the connection information; and an end-user-device user input component coupled to the second processing unit; wherein the second processing unit is also configured to electronically obtain the fitting data from the fitting device, and wherein the end user device is configured to configure the hearing device based on the fitting data; and (3) wherein the fitting device comprises: a fitting-device user input component configured to obtain a user input; and a third processing unit configured to electronically generate the first information based on the user input, and to provide the first information for transmission to the electronic device, the first information relating to the request for establishing communication between the fitting device and the end user device, the end user device being configured to configure the hearing device; wherein the third processing unit is also configured to obtain the connection information associated with the virtual fitting room from the electronic device; and wherein the fitting device is configured to communicatively connect with the virtual fitting room based on the connection information, and to communicate with the end user device via the virtual fitting room.

A method performed by an electronic device includes: electronically obtaining, by an input, first information relating to a request for establishing communication between a fitting device and an end user device, the end user device being configured to configure a hearing device based on fitting data from the fitting device; electronically processing, by a processing unit, the first information to provide second information for transmission to an AV provider; obtaining, by the processing unit, a connection information associated with a virtual fitting room from the AV provider; providing, by the processing unit, the connection information associated with the virtual fitting room for the fitting device; and providing, by the processing unit, the connection information associated with the virtual fitting room for transmission to the end user device.

Optionally, the connection information associated with the virtual fitting room is configured to allow the fitting device and the end user device to communicatively connect with each other.

Optionally, the first information comprises a request for the connection information, a request to set up a virtual meeting, a request for a session, a request for handshake, or a request that will lead to an establishment of a communication bridge between the fitting device and the end user device.

Optionally, the second information comprises a request for the connection information, a request to set up a virtual meeting, a request for a session, a request for handshake, or a request that will lead to an establishment of a communication bridge between the fitting device and the end user device.

Optionally, the second information is the same as the first information.

Optionally, the connection identification comprises a virtual fitting room identification.

Optionally, the method further comprises obtaining a first caller identification for the fitting device, and providing the first caller identification for transmission to the fitting device.

Optionally, the method further comprises obtaining a second caller identification for the end user device, and providing the second caller identification for transmission to the end user device.

Optionally, the electronic device comprises a server that is configured to communicate with the fitting device, the AV provider, and a notification server that is configured to provide VoIP message for the end user device.

A method performed by an end user device includes: receiving, by a first communication device, a connection information; operating, by a processing unit, the first communication device to communicatively connect the end user device with a fitting device through a virtual fitting room based on the connection information; electronically obtaining, by the processing unit, fitting data from the fitting device; and configuring a hearing device based on the fitting data.

Optionally, the method further comprises configuring the hearing device by communicating with the hearing device via a second communication device.

Optionally, the method further comprises communicating with the fitting device and/or receiving data from the fitting device via a chat channel of the virtual fitting room.

Optionally, the act of electronically obtaining the fitting data comprises electronically obtaining the fitting data via the chat channel.

Optionally, the method further comprises configuring the hearing device based on the fitting data by transmitting the fitting data to the hearing device.

Optionally, the connection information comprises a virtual fitting room identification and a caller identification associated with the end user device, and wherein the first communication device is operated by the processing unit to communicatively connect the end user device with the fitting device through the virtual fitting room based on both the virtual fitting room identification and the caller identification.

Optionally, the connection information is received from a notification server.

Optionally, the connection information is a part of a VoIP message provided by the notification server.

Optionally, the fitting data comprises hearing aid fitting data.

Optionally, the end user device comprises a cellular phone, a tablet, a computer, a laptop, a handheld device, or a remote control.

A method performed by a fitting device includes: obtaining, a user input by a user input component; electronically generating, by a processing unit, first information based on the user input; providing, by the processing unit, the first information for transmission to an electronic device, the first information relating to a request for establishing communication between the fitting device and an end user device, the end user device being configured to configure a hearing device; obtaining, by the processing unit, a connection information associated with a virtual fitting room from the electronic device; communicatively connecting with the virtual fitting room based on the connection information; and communicating with the end user device via the virtual fitting room.

Optionally, the act of communicating with the end user device is performed by the fitting device via a chat channel of the virtual fitting room.

Optionally, the method further comprises providing, by the processing unit, fitting data for transmission to the end user device via the chat channel.

Optionally, the fitting data comprises hearing aid fitting data.

Optionally, the method further comprises generating a control signal, by the processing unit, for transmission via the chat channel, wherein the control signal is configured to cause the end user device to configure the hearing device.

Optionally, the connection information comprises a virtual fitting room identification and a caller identification for the fitting device, and wherein the communication device is operated to communicatively connect the fitting device with the end user device through the virtual fitting room based on both the virtual fitting room identification and the caller identification.

A product includes a processor-readable medium storing a set of instructions, an execution of which will cause any of the above methods to be performed.

A product includes a processor-readable medium storing a set of instructions, an execution of which will cause a method to be performed by an electronic device, the method comprising: electronically obtaining, by an input, first information relating to a request for establishing communication between a fitting device and an end user device, the end user device being configured to configure a hearing device based on fitting data from the fitting device; electronically processing, by a processing unit, the first information to provide second information for transmission to an AV provider; obtaining, by the processing unit, a connection information associated with a virtual fitting room from the AV provider; providing, by the processing unit, the connection information associated with the virtual fitting room to the fitting device; and providing, by the processing unit, the connection information associated with the virtual fitting room for transmission to the end user device.

A product includes a processor-readable medium storing a set of instructions, an execution of which will cause a method to be performed by an end user device, the method comprising: receiving, by a first communication device, a connection information; operating, by a processing unit, the first communication device to communicatively connect the end user device with a fitting device through a virtual fitting room based on the connection information; and electronically obtaining, by the processing unit, fitting data from the fitting device; wherein the end user device is configured to configure a hearing device based on the fitting data.

A product includes a processor-readable medium storing a set of instructions, an execution of which will cause a method to be performed by a fitting device, the method comprising: obtaining, a user input by a user input component; electronically generating, by a processing unit, first information based on the user input; providing, by the processing unit, the first information for transmission to an electronic device, the first information relating to a request for establishing communication between the fitting device and an end user device, the end user device being configured to configure a hearing device; obtaining, by the processing unit, a connection information associated with a virtual fitting room from the electronic device; communicatively connecting with the virtual fitting room based on the connection information; and communicating with the end user device via the virtual fitting room.

Other and further aspects and features will be evident from reading the following detailed description.

BRIEF DESCRIPTION OF THE DRAWINGS

The drawings illustrate the design and utility of embodiments, in which similar elements are referred to by common reference numerals. In order to better appreciate how advantages and objects are obtained, a more particular description of the embodiments will be described with reference to the accompanying drawings. Understanding that these drawings depict only exemplary embodiments and are not therefore to be considered limiting in the scope of the claimed invention.

DESCRIPTION OF THE EMBODIMENTS

Figure 1A:
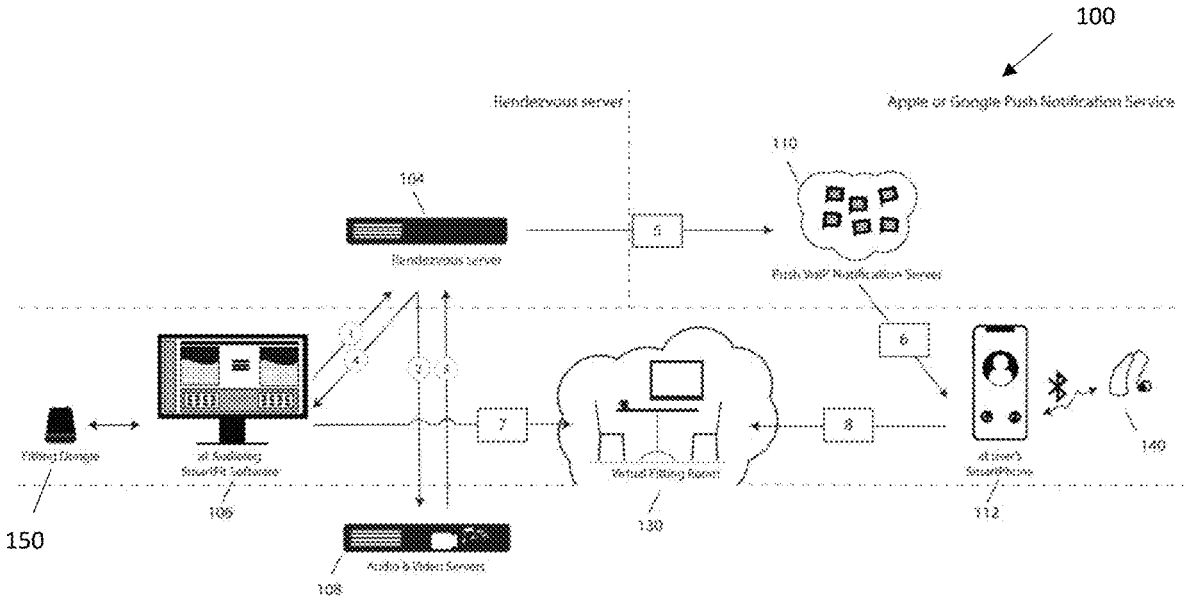
FIG. 1A illustrates a hearing system that includes an electronic device, a fitting device, and an end user device configured to configure a hearing device in accordance with some embodiments.

Various embodiments are described hereinafter with reference to the figures. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages of the invention shown. An aspect or an advantage described in conjunction with a particular embodiment is not necessarily limited to that embodiment and can be practiced in any other embodiments even if not so illustrated or if not so explicitly described.

FIG. 1A illustrates a hearing system 100 that includes an electronic device 104, a fitting device 106, and an end user device 112 configured to configure a hearing device 140 in accordance with some embodiments. The electronic device 104 is configured to communicate with an audio-and-video (AV) provider 108 to assist an establishment of a communication link for allowing the fitting device 106 and the end user device 112 to communicate with each other.

The AV provider 108 may be any device configured to provide one or more communication channels between two or more parties (e.g., the fitting device 106 and the end user device 112), which communication channel(s) allows the parties to exchange video data, audio data, chat data, information (that is not video data, not audio data, and not chat data), or any combination of the foregoing. The communication channel(s) provides a virtual fitting room 130 that simulates a fitting environment, so that the health care professional operating the fitting device 106 and the user of the hearing device 140 can communicate with each other to determine fitting data for configuring the hearing device 140. As used in this specification, the term "virtual fitting room" may refer to an environment, a meeting, a session, one or more communication channels, or any communication feature(s), that allows two devices to remotely communicate with each other for determining fitting data and/or for configuring a hearing device. In some embodiments, the AV provider 108 may be configured to provide a user interface for display on a screen associated with the fitting device 106, and to provide a user interface for display on a screen associated with the end user device 112. The AV provider 108 may be a device that provides video conferencing interfaces and/or video conferencing software, such as Zoom, Cisco Webex, GoToMeeting, Google Hangouts Meet, join.me, BlueJeans Meetings, Cisco Jabber, TeamViewer, Adobe Connect, etc. In some embodiments, the AV provider 108 may provide user interfaces via the Internet for the fitting device 106 and the end user device 112, respectively. Also, in some embodiments, the AV provider 108 may provide video conferencing software for downloaded by the fitting device 106 and the end user device 112. In some embodiments, the AV provider 108 may include one or more devices (e.g., server(s), computer(s), etc.) provided and/or controlled by a company. In other embodiments, the AV provider 108 may be the company that provides the video conferencing features.

The fitting device 106 is configured to provide fitting data for reception by the end user device 112 and/or the hearing device 140. The fitting device 106 is configured to communicate with the end user device 112 and/or the hearing device 140 via the communication channel of the virtual fitting room 130 provided by the AV provider 108. Upon receipt of the fitting data, the end user device 112 then configures a hearing device 140 based on the fitting data provided by the fitting device 106. The hearing device 140 and the end user device 112 have the same user. The hearing device 140 and the end user device 112 may be communicatively coupled to each other wirelessly (e.g., via a short range network such as a Bluetooth network), or by a cable connection. In some embodiments, the fitting device 106 may include fitting software configured to receive information regarding hearing characteristic(s) (e.g., hearing loss characteristic, hearing preference, etc.) of the user of the hearing device 140, and generate fitting data based on the hearing characteristic(s). In some embodiments, the fitting software may also obtain information regarding the hearing device 140 being configured, and generate the fitting data based on such information. The information regarding the hearing device 140 may include one or more of: hearing device identifier, hearing device functionality identifier identifying one or more functions of the hearing device, state identifier identifying a state of the hearing device, usage information of the hearing device, model identifier identifying a model of the hearing device, one or more keys associated with the hearing device for allowing secure communication with the hearing device, etc. Also, in some embodiments, the fitting device 106 may be operated by a health care provider (e.g., a hearing professional, such as a fitter, an audiologist, etc.).

In some embodiments, the electronic device 104, the fitting device 106, and the AV provider 108, or respective components therein, may be provided and/or controlled by different respective companies. In other embodiments, the electronic device 104, the fitting device 106, and the AV provider 108, or respective components therein, may be provided and/or controlled by the same company. In further embodiments, two of the electronic device 104, the fitting device 106, and the AV provider 108, or respective components therein, may be provided and/or controlled by the same company. For example, the AV provider 108 and the electronic device 104, or respective components therein, may be provided and/or controlled by the same company. As another example, the AV provider 108 and the fitting device 106, or respective components therein, may be provided and/or controlled by the same company. As a further example, the electronic device 104 and the fitting device 106, or respective components therein, may be provided and/or controlled by the same company.

The virtual fitting room 130 is advantageous because it allows the fitting device 106 to remotely configure the hearing device 140 via the end user device 112. In particular, the fitting device 106 and the hearing device 140 may be located in different respective geographical locations, but the user of the hearing device 140 can have his/her hearing device 140 configured by the fitting device 106 remotely through the virtual fitting room 130.

In one method performed by the system 100, the fitting device 106 may generate and send first information to the electronic device 104 (see arrow 1 in FIG. 1A). The generation of the first information may be performed based on an input received at the fitting device 106. For example, a health care professional using the fitting device 106 may operate a user input (e.g., a physical button, input device, graphical user interface, etc.) at the fitting device 106 to cause the fitting device 106 to send the first information. As another example, the fitting device 106 may send the first information to the electronic device 104 in response to an input transmitted to the fitting device 106 from another device. The first information may relate to a request for establishing a communication between the fitting device 106 and the end user device 112. By means of non-limiting examples, the first information may be a request for the connection information, a request to set up a virtual meeting, a request for a session, a request for handshake, or a request or any information that will lead to or will assist an establishment of a communication bridge between the fitting device 106 and the end user device 112. Also, in some embodiments, the first information may include one or more of: health care professional identifier identifying a user of the fitting device 106, fitting device identifier identifying the fitting device 106, hearing device identifier identifying the hearing device 140, end user device identifier identifying the end user device 112, a user identifier identifying the user of the hearing device 140, etc.

The electronic device 104 processes the first information, and provides second information for transmission to the AV provider 108 (see arrow 2 in FIG. 1A). In some embodiments, the processing of the first information may comprise one or more of: checking or verifying the first information, storing the first information, generating a request to be sent to the AV provider 108 based on the first information, associating the first information with a request to be sent to the AV provider 108, etc., or any combination of the foregoing. In other embodiments, the processing of the first information may simply be forwarding the first information as the second information. In some embodiments, the first information may include fitting device identifier (identifying the fitting device 106 or its user), hearing device identifier (identifying the hearing device 140 or its user), end user device identifier (identifying the end user device 112 or its user), user identifier identifying user of the hearing device 140, or any combination of the foregoing. In such cases, the processing of the first information may include checking or verifying one or more of these identifiers, storing one or more of these identifiers, and/or associating one or more of these identifiers with a request for establishing a connection (to be sent to the AV provider 108). Also, in some embodiments, the processing of the first information may include checking to determine if a connection can be established based on the first information. For example, if the first information includes a hearing device identifier (identifying the hearing device 140) and a fitting device identifier (identifying the fitting device 106), the electronic device 104 may determine if the hearing device identifier is within a list of approved hearing device identifiers, and if the fitting device identifier is within a list of approved fitting device identifiers. If so, then the electronic device will provide second information to the AV provider 108 requesting for a connection to be established.

In some embodiments, the electronic device 104 may be configured to provide the second information based on a verification of one or more identifications. As described, in some embodiments, the identification(s) being verified may be hearing device identifier and/or fitting device identifier. Alternatively, or additionally, the identification(s) being verified may be an identifier associate with a last fitted session, and/or a patient ID. The identifier associated with the last fitted session may be a session identifier, or any data generated for the last fitted session. The patient ID may be any information identifying the user of the hearing device 140, or any information that can link to the hearing device 140. In some cases, the hearing device identifier itself may be used as the patient ID. In some embodiments, the hearing device identifier may be an identifier provided for the particular hearing device when the hearing device is manufactured, or it may be an identifier assigned for the particular hearing device after it is manufactured.

The second information may relate to a request for establishing a communication between the fitting device 106 and the end user device 112. By means of non-limiting examples, the second information may be a request for the connection information, a request to set up a virtual meeting, a request for a session, a request for handshake, or a request or any information that will lead to an establishment, or that will assist in an establishment, of a communication bridge between the fitting device 106 and the end user device 112. Also, in some embodiments, the second information may include one or more of: health care professional identifier identifying a user of the fitting device 106, fitting device identifier identifying the fitting device 106, hearing device identifier identifying the hearing device 140, end user device identifier identifying the end user device 112, a user identifier identifying the user of the hearing device 140, etc. In some embodiments, the second information may be the same as the first information. In such cases, the electronic device 104 may simply receive the first information, and may pass the information as the second information for reception by the AV provider 108. In other embodiments, the second information may be different from the first information. For example, the second information may be derived from the first information, may be determined based on an algorithm that utilizes the first information as input, may be looked up in a look-up table based on the first information, may be obtained by including at least some of the first information in a package, or may be determined in any manner based on the first information. In further embodiments, the second information may not include any fitting device identifier, hearing device identifier, end user device identifier, and user identifier identifying user of the hearing device 140. Also, in some embodiments, the second information may not include any information from the first information. Instead, the second information may simply be a request transmitted by the electronic device 104 for requesting a connection bridge to be established. In some embodiments, the first information may be information regarding a call initiated from the fitting device 106, and the second information may be any information sent by the electronic device 104 to the AV provider 108 for setting-up the virtual fitting room 130. The electronic device 104 may configure the second information so that it has a format that is understandable by the AV provider 108.

In some embodiments, the second information may be a request for fitting room identification or any information that may cause a generation of a fitting room identification, a request for a caller identification (ID) (e.g., a first caller identification) for the fitting device 106 (or its user) or any information that may cause a generation of a caller identification (ID) for the fitting device 106 (or its user), a request for a caller identification (ID) (e.g., a second caller identification) for the end user device 112 (or its user) or any information that may cause a generation of a caller identification (ID) for the end user device 112 (or its user), or any combination of the above requests. If the second information includes multiple ones of the above requests, the electronic device 104 may transmits the multiple requests in one transmission, or may transmit the multiple requests in multiple transmissions in different times.

The AV provider 108 obtains the second information, and processes the second information to obtain a connection information associated with the virtual fitting room 130. In some embodiments, the processing of the second information by the AV provider 108 may comprise one or more of: checking or verifying the second information, storing the second information, associating the second information with a session identification, associating the second information with a virtual fitting room identification, associating the second information with one or more caller identifications (e.g., identification associated with the fitting device 106 and/or identification associated with the end user device 112 or the hearing device 140, etc.), etc. In some embodiments, the second information is simply a request transmitted by the electronic device 104 (and such second information may not include any information from the first information). In such cases, when the AV provider 108 receives the second information, the AV provider 108 will check to determine if the electronic device 140 providing the second information has an account with the AV provider 108. If so, then the AV provider 108 will generate the connection information for the electronic device 140. The connection information may be any information that is usable by the fitting device 106 to connect to the virtual fitting room 130 for communication with the end user device 112, and/or any information that is usable by the end user device 112 to connect to the virtual fitting room 130 for communication with the fitting device 106. By means of non-limiting examples, the connection information may be one or more of: a virtual fitting room identification, caller ID for the fitting device 106 (or its user), caller ID for the end user device 112 (or its user), password, session information, encryption key, decryption key, etc. The AV provider 108 then provides the connection information associated with the virtual fitting room 130 to the electronic device 104 (see arrow 3 in FIG. 1A) for transmission by the electronic device 104 to the fitting device 106. The electronic device 104 obtains the connection information, and provides the connection information associated with the virtual fitting room 130 for transmission to the fitting device 106 (see arrow 4 in FIG. 1A). The connection information allows the fitting device 106 to connect to the virtual fitting room 130 (see arrow 7 in FIG. 1A). In one implementation, the connection information transmitted from the electronic device 104 to the fitting device 106 includes at least the virtual fitting room identification and/or the caller ID for the fitting device 106 (or its user).

The electronic device 104 also provides the connection information associated with the virtual fitting room 130 for transmission to the end user device 112. In the illustrated embodiments, the transmission of the connection information associated with the virtual fitting room 130 is transmitted to the end user device 112 via a notification server 110. In such cases, the electronic device 104 provides the connection information for transmission to the notification server 110 (see arrow 5 in FIG. 1A). The notification server 110 then provides the connection information for transmission to the end user device 112 (see arrow 6 in FIG. 1A). The connection information allows the end user device 112 to connect to the virtual fitting room 130 (see arrow 8 in FIG. 1A). In one implementation, the connection information transmitted from the electronic device 104 to the end user device 112 via the notification server 110 includes at least the virtual fitting room identification and/or the caller ID for the end user device 112 (or its user).

In some embodiments, the notification server 110 may be configured to provide push notification service (e.g., VoIP notification service). In some cases, the notification server 110 may be implemented using a third-party notification service, such as Apple or Google Push Notification Service. In other cases, the notification server 110 may be implemented using other notification services, and/or may be provided and/or controlled by the company providing the AV provider 108, the company providing the fitting device 106, or the company providing the electronic device 104. In other embodiments, the notification server 110 may be implemented in the electronic device 104. In such cases, the push notification service described herein may be provided by the electronic device 104. In further embodiments, the hearing system 100 may not include the notification server 110. In such cases, the electronic device 104 may be configured to transmit the connection information to the end user device 112 without going through the notification server 110.

Figure 1B:
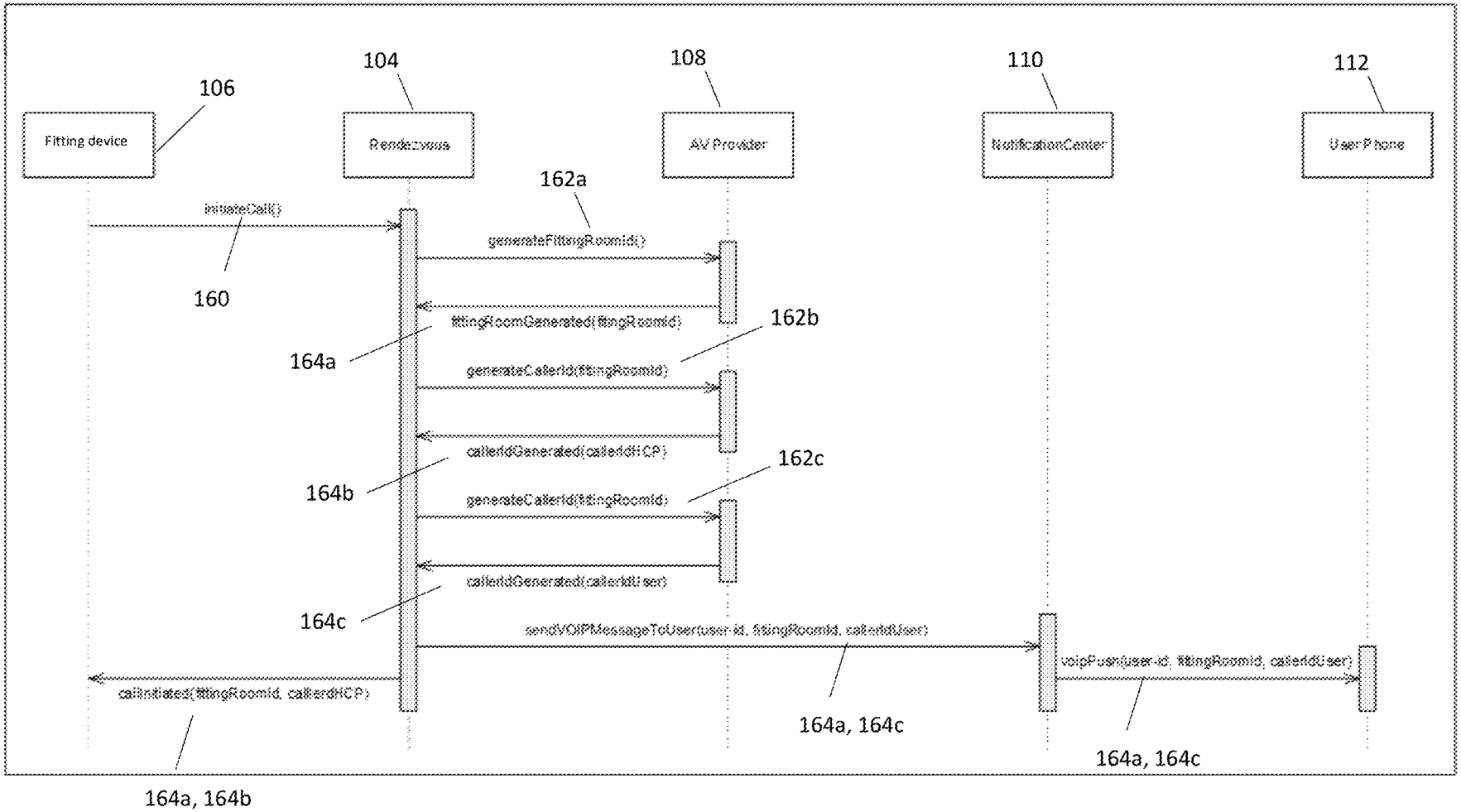
FIG. 1B illustrates an example of information flow among components of the hearing system of FIG. 1A.

FIG. 1B illustrates an example of information flow among components of the hearing system of FIG. 1A. In particular, the figure shows an example of how the fitting device 106 obtains the virtual fitting room identification and the caller ID for the fitting device 106 (or its user) from the AV provider 108, and how the end user device 112 obtains the fitting room identification and caller ID for the end user device 112 (or its user) from the AV provider 108.

As shown in FIG. 1B, the fitting device 106 transmits first information 160 to the electronic device 104. In the illustrated example, the first information 160 includes a request to establish an communication link. In response to the first information, the electronic device 104 transmits a request 162*a* for virtual fitting room identification, a request 162*b* for a caller ID for the fitting device 106 (or its user), and a request 162*c* for a caller ID for the end user device 112 (or its user), to the AV provider 108. The requests 162*a*-162*c* may be example of second information transmitted from the electronic device 104 to the AV provider 108. The AV provider 108 generates the virtual fitting room identification 164*a*, the caller ID 164*b* for the fitting device 106 (or its user), and the caller ID 164*c* for the end user device 112 (or its user), and transmits such information to the electronic device 104. In the example, the transmissions of the virtual fitting room identification 164*a*, the caller ID 164*b*, and the caller ID 164*c* by the AV provider 108 are performed in sequence in response to each respective requests transmitted by the electronic device 104. In other example, the electronic device 104 may transmit a single request for the virtual fitting room identification 164*a* and for the caller IDs 164*b*, 164*c*. In such cases, the AV provider may transmit the virtual fitting room identification 164*a* and the caller IDs 164*b*, 164*c* to the electronic device 104 in a single transmission. As shown in the figure, after the electronic device 104 obtains the requested virtual fitting room identification 164*a* and the caller IDs 164*b*, 164*c*, the electronic device 104 transmits the virtual fitting room identification 164*a* and the caller ID 164*b* for the fitting device 106 (or its user). The electronic device 104 also transmits the virtual fitting room identification 164*a* and the caller ID 164*c* for the end user device 112 (or its user) to the notification server 110. The notification server 110 then pushes the virtual fitting room identification 164*a* and the caller ID 164*c* to the end user device 112. In the example, the electronic device 104 also transmits a user ID to the notification server 110, wherein the user ID is for identifying the end user device 112. This allows the notification server 110 to identify the end user device 112 for transmission of the virtual fitting room identification 164*a* and the caller ID 164*c*.

Returning to FIG. 1A, after the fitting device 106 and the end user device 112 obtain the connection information, they can then communicatively connect to each other via the virtual fitting room 130 based on the connection information (see arrows 7, 8 in FIG. 1A). In some embodiments, the fitting device 106 may connect to the virtual fitting room 130 based on the connection information (e.g., the virtual fitting room identification, caller ID for the fitting device 106 or its user, session identification, etc., or any combination of the foregoing). Also, the end user device 112 may connect to the virtual fitting room 130 based on the connection information (e.g., the virtual fitting room identification, caller ID for the end user device 112 or its user, session identification, etc., or any combination of the foregoing).

The above technique of communicatively connecting the fitting device 106 and the end user device 112 through their respective caller IDs is advantageous because it prevents others from connecting to the same virtual fitting room. In some embodiments, the fitting device 106 and/or the end user device 112 and/or the hearing device 140 may generate a fitting identification. In such cases, the connection information provided by the AV provider 108 for connecting the fitting device 106 with the end user device 112 may be based on the fitting identification. In some embodiments, the connection information may include a virtual fitting room identification, a caller ID for the fitting device 106, a caller ID for the end user device 112, or any combination of the foregoing. In such cases, any of such information may be stored in association with the fitting identification.

In some embodiments, the time period from (1) the transmission of the first information from the fitting device 106, to (2) the establishment of the connection between the fitting device 106 and the end user device 112, may occur within a few minutes, and more preferably, within a minute, within 30 seconds, or less. In one implementation, the fitting device 106 may include a user interface having a button (e.g., a physical button, or a graphical button in a graphical user interface). Upon activation of the button, the fitting device 106 transmits the first information to the electronic device 104, causing the electronic device 104 to (1) cooperate with the AV provider 108 to set-up the virtual fitting room 130, (2) communicatively connect itself to the virtual fitting room 130, and (3) cooperate with the notification server 110 to send connection information to the end user device 112. For example, the notification server 110 may send a link to the user via text messaging. If the user of the end user device 112 selects the link, the end user device 112 will then be connected to the virtual fitting room 130. For example, upon the user selecting the link, the end user device 112 may display a graphical user interface for video conferencing and for obtaining fitting data. Alternatively, the notification server 110 may push a "call" to the end user device 112. If the user of the end user device 112 accepts the call, the end user device 112 will then be connected to the virtual fitting room 130. For example, upon the user accepting the call, the end user device 112 may display a graphical user interface for video conferencing and for obtaining fitting data. Accordingly, from the perspective of the user of the fitting device 106, the pressing of the button appears to initiate a call (e.g., a video conference call) to the end user device 112, and upon acceptance of the call by the user of the end user device 112, the fitting device 106 and the end user device 112 will be connected to the virtual fitting room 130.

In other embodiments, the connection may not be established shortly after the button at the fitting device 106 is pressed. Instead, the connection may be scheduled to be established at a later time. In such cases, the electronic device 104 may be configured to send a schedule information along with, or as a part of, the connection information to the fitting device 106 and the end user device 112. For example, the schedule information may include a date and a time for a fitting session. The schedule information may be in a format of a calendar item for an application, such as an outlook item. Also, in some embodiments, the schedule information sent to the fitting device 106 may include a link for the user of the fitting device 106 to select at the scheduled time, and the schedule information sent to the end user device 112 may include a link for the user of the end user device 112 to select at the scheduled time. In some embodiments, the electronic device 104 may transmit the connection information (e.g., the virtual fitting room identification and/or the caller ID for the fitting device 106 or its user) to the fitting device 106 in a form of a meeting invite, such as a zoom invite. The fitting device 106 may be configured to automatically calendar the invite (e.g., saving the invite in a calendar). Also, the electronic device 104 and/or the notification server 110 may transmit the connection information (e.g., the virtual fitting room identification and/or the caller ID for the end user device 112 or its user) to the end user device 112 in a form of a meeting invite, such as a zoom invite. The end user device 112 may be configured to automatically calendar the invite (e.g., saving the invite in a calendar).

After the fitting device 106 and the end user device 112 are connected to the virtual fitting room 130, the fitting device 106 and the end user device 112 may exchange data via one or more communication channels of the virtual fitting room 130 in a fitting session. By means of non-limiting examples, the data may be video conference data (e.g., video data and/or audio data), fitting data, commands, control signals, or any combination of the foregoing.

In particular, during the fitting session, the user of the end user device 112 may communicate with a health care professional using the fitting device 106 via the virtual fitting room 130, as in a video conference. For example, the end user device 112 may have a camera capturing images of the user of the end use device 112, and a microphone capturing speech of the user of the end user device 112. The end user device 112 may transmit the images (e.g., as in a video) for display at the fitting device 106, and may transmit audio data of the captured speech to the fitting device 106. Similarly, the fitting device 106 may have a camera capturing images of the health care professional of the fitting device 106, and a microphone capturing speech of the health care professional of the fitting device 106. The fitting device 106 may transmit the images (e.g., as in a video) for display at the end user device 112, and may transmit audio data of the captured speech to the end user device 112. The transmission of the images and audio data between the fitting device 106 and the end user device 112 may be achieved via one or more channels of the virtual fitting room 130. In some embodiments, the AV provider 108 may be configured to provide user interfaces for display respectively at the fitting device 106 and the end user device 112, which allow users of the fitting device 106 and the end user device 112 to communicate with each other, as in a video conference.

In some embodiments, during the fitting session conducted via the virtual fitting room 130, the health care professional using the fitting device 106 may ask the user of the end user device 112 questions regarding hearing characteristics (e.g., hearing loss, hearing preference, etc.) of the user, and the user of the end user device 112 may provide input regarding the user's hearing characteristics. The input may be in the form of verbal input, visual input (e.g., a person nodding), and/or data input (e.g., data generated by the user operating an interface at the end user device 112). In some embodiments, the video conference graphical interface provided by the AV provider 108 may include a region for allowing the fitting device 106 and the end use device 112 to exchange text messages. The health care professional may utilize such chat channel to communicate with the user of the end user device 112. For example, the health care professional may provide instruction (e.g., instruction to perform hearing test tasks, instruction to operate the end user device 112 and/or the hearing device 140, etc.) and information to the user of the end user device 112 via the chat channel of the virtual fitting room 130.

Also, in some embodiments, the fitting device 106 may transmit one or more audio files to the end user device 112 via one or more channels of the virtual fitting room 130. The audio files may be processed by the end user device 112 for presentation as sound to the user via speaker(s) of the end user device 112. After the user listens to the sound (with and/or without the use of the hearing device 140), the health care professional may then ask the user to provide input regarding his/her listing ability and/or experience. Based on the user input, the fitting device 106 may then determine fitting data for configuring the hearing device 140. Alternatively, instead of presenting the audio files as sound via speaker(s) of the end user device 112, the end user device 112 may transmit audio data of the audio file(s) to the hearing device 140 (e.g., wirelessly or via a cable). In such cases, the hearing device 140 processes the audio data and presents corresponding sound for presentation to the user of the hearing device 140. After the user listens to the sound output by the hearing device 140, the health care professional may then ask the user to provide input regarding his/her listing ability and/or experience. Based on the user input, the fitting device 106 may then determine fitting data for configuring the hearing device 140.

In some embodiments, the transmission of fitting data from the fitting device 106 to the end user device 112 may be accomplished using a channel of the virtual fitting room 130, such as the chat channel. As described, the video conferencing graphical interface provided by the AV provider 108 may include a region for allowing the fitting device 106 and the end use device 112 to exchange text messages. The fitting device 106 may transmit fitting data to the end user device 112 via the chat channel. In the illustrated embodiments, the end user device 112 is configured to distinguish fitting data from chat data received at the chat channel. For example, the end user device 112 may include an interpreter configured to distinguish text messages from fitting data. In some embodiments, the fitting device 106 is configured to prepare (e.g., package) the fitting data so that when the end user device 112 receives the fitting data, the interpreter of the end user device 112 will recognize the data as fitting data. For example, the fitting device 106 may insert a header value (e.g., "1") in a certain predetermined header field for a packet containing the fitting data, wherein the header value indicates that the body of the data in the packet is fitting data. In such cases, after the end user device 112 receives the packet via the virtual fitting room 130, the interpreter processes the header to determine whether the data in the packet is chat data or fitting data. In the above example, because the header value in the predetermined header field has a value of "1", the interpreter then knows that the data being transmitted in the packet is fitting data. Accordingly, the end user device 112 then transmits the fitting data to the hearing device 140. In some embodiments, the transmission of the fitting data to the hearing device 140 may be performed wirelessly, such as via Bluetooth. In such cases, when the end user device 112 identifies the data received via the chat channel as fitting data, the end user device 112 then operates the Bluetooth communication device to transmit the fitting data wirelessly to the hearing device 140.

As another example, the fitting device 106 may insert a header value (e.g., "2") in a certain predetermined header field for chat data, wherein the header value indicates that the data being transmitted is chat data. In such cases, after the end user device 112 receives the data via the virtual fitting room 130, the interpreter processes the header to determine whether the data is chat data or fitting data. In the above example, because the header value in the predetermined header field has a value of "2", the interpreter then knows that the data being transmitted is chat data. Accordingly, the end user device 112 will display the chat data in a chat field of the user interface for the user to read.

In some embodiments, if the data received via the chat channel is chat data, the end user device 112 then presents the chat data (message) at the end user device 112 (e.g., in a graphical user interface displayed on the screen of the end user device 112). On the other hand, if the data received via the chat channel is fitting data, the end user device 112 then transmits the fitting data to the hearing device 140 to configure the hearing device 140, and/or transmits a control signal based on the fitting data to the hearing device 140 to configure the hearing device 140. In some embodiments, the fitting device 106 is configured to mark data (for transmission via the chat channel) as a certain type. For example, the fitting device 106 may mark data as "BLE" type to indicate that the data being transmitted via the chat channel is to be sent to the hearing device 140 via Bluetooth Low Energy communication. As another example, the fitting device 106 may mark data as "Chat" type to indicate that the data is chat data that is to be displayed at the end user device 112 (e.g., by an application at the end user device 112). The interpreter in the end user device 112 is configured to interpret the data type (e.g., "BLE", "Chat", etc.), and to take the corresponding action.

In some embodiments, the fitting device 106 may be configured to encrypt fitting data (e.g., using an encryption key) that is to be transmitted to the end user device 112 via the chat channel of the virtual fitting room 130, and that is to be transmitted from the end user device 112 to the hearing device 140. For example, assuming the fitting device 106 determines that the values 10, 20, 30 are to be sent to the hearing device 140 for configuring the hearing device 140, the fitting device 106 first encrypt the value 10, 20, 30 (in this example, assuming that these values are encrypted to have encrypted values 56, 34, 12). Then the fitting device 106 sends the command "write (56, 34, 12)" via the chat channel of the virtual fitting room 130. In some embodiments, the fitting device 106 may be configured to encrypt only the payload portion (e.g., the values 10, 20, 30 in the example), and not the command "write". In other embodiments, the fitting device 106 may encrypt both the command (e.g., "write") and the payload (e.g., the values 10, 20, 30). The command transmitted via the chat channel is received by the end user device 112. The end user device 112 recognizes that the data being transmitted via the chant channel is not chat data, but is fitting data. Accordingly, the end user device 112 sends the fitting data (with encrypted values 56, 34, 12 in this example) to the hearing device 140. In some embodiments, the hearing device 140 decrypts the data and obtains the decrypted data 10, 20, 30 along with the "write" command. In other embodiments, the end user device 112 may decrypt the data, and may transmit the decrypted data to the hearing device 140. The hearing device 140 then performs the action prescribed by the command, e.g., by writing (e.g., storing) the values 10, 20, 30 in a memory, such as a flash. Other examples of command that can be sent by the fitting device 106 for reception by the end user device 112 and/or the hearing device 140 include read, start, stop, etc. Also, in some embodiments, a certain protocol. (e.g., WebLink) may be utilized for sending information (e.g., commands) by the fitting device 106 for configuring the hearing device 140.

In other embodiments, both the command (e.g., "write") and the payload (e.g., values 10, 20, 30) may be encrypted by the fitting device 106 before the fitting device 106 transmits them through the chat channel of the virtual fitting room 130.

Also, in some embodiments, the chat channel of the virtual fitting room 130 may be encrypted. In such cases, all data transmitted by the fitting device 106 will be encrypted by the AV provider 108 at the transmitting end, and the encrypted data will be decrypted by the AV provider 108 when the data reaches the receiving end. In other embodiments, the chat channel of the virtual fitting room 130 may not be encrypted.

In addition, in some embodiments, the end user device 112 may encrypt data received from the fitting device 106 before transmitting the data to the hearing device 140. In other embodiments, the end user device 112 may not encrypt the data received from the fitting device 106 before transmitting the data to the hearing device 140.

Also, in some embodiments, the end user device 112 may convert the message received from the fitting device 106 via the chat channel into one or more corresponding Bluetooth operations. For example, in some embodiments, a command "write" may be translated into a writing operation (1-1 translation). In other embodiments, a command may be translated into multiple operations (1-N translation).

In some embodiments, the configuration message received by the end user device 112 and/or the hearing device 140 may have the format: [Command, Identifier, Data], wherein "command" is the action to be performed, "identifier" is for device identification, and "data" is one or more values associated with the command. In some cases, the identifier may be a Bluetooth name or unique identifier for identifying an entity to which the command is to be applied over a Bluetooth channel, or for identifying the communication channel (e.g., the Bluetooth channel). For example, the configuration message "Write XYZ 10, 20, 30" indicates that a writing command is to be performed to write data 10, 20, 30 to a device named XYZ, or to write data 10, 20, 30 to a device via a communication channel named "XYZ".

In some embodiments, the end user device 112 may be configured to configure the hearing device 140 as the end user device 112 receives the fitting data via the chat channel of the virtual fitting room 130. In other embodiments, the end user device 112 may be configured to store the fitting data in a non-transitory medium in the end user device 112. In such cases, after all fitting data have been received, the end user device 112 may then access the stored fitting data and transmit them to the hearing device 140 to configure the hearing device 140, or may generate control signals based on the stored fitting data to configure the hearing device 140.

In other embodiments, the health care professional using the fitting device 106 may conduct the fitting session via the virtual fitting room 130 to determine fitting data. For example, during the fitting session, the user of the hearing device 140 may perform one or more hearing tests, which allow the fitting device 106 to determine the fitting data. After all of the fitting data have been determined, the health care professional may operate a button (e.g., a physical button, or a button in a graphical user interface displayed in a screen) at the fitting device 106 to cause a configuration process for configuring the hearing device 140 to begin. In some embodiments, the actuation of the button causes the fitting data to be transmitted from the fitting device 106 to the end user device 112 via a channel (e.g., the chat channel) of the virtual fitting room 130. The end user device 112 receives the fitting data via the channel of the virtual fitting room 130, and uses the fitting data to configure the hearing device 140. If the channel is a chat channel, the interpreter in the end user device 112 may be configured to recognize the incoming data as fitting data. The end user device 112 may transmit the fitting data to the hearing device 140 to configure the hearing device 140, or may generate control signals based on the fitting data to configure the hearing device 140.

In some embodiments, the fitting data may include command(s) and/or control signal(s) for configuring the hearing device 140. By means of non-limiting examples, the command(s) may be a command to select a certain hearing program in the hearing device 140, a command to adjust a gain in a certain frequency range by a certain amount, a command to adjust a compression setting, a command to select a mode of the hearing device 140, etc. Alternatively or additionally, the fitting data may include hearing processing parameter(s) for use by the hearing device 140 to process sound.

In further embodiments, during the fitting session conducted via the virtual fitting room 130, the fitting device 106 may provide fitting data that includes command(s) for configuring the hearing device 140. The command(s) is received via the chat channel by the end user device 112. When the interpreter in the end user device 112 recognize that the data from the chat channel is command(s) for configuring the hearing device 140, the end user device 112 will then communicate with the hearing device 140 to configure the hearing device 140. For examples, there may be one or more commands for changing the amplification, the sound processing algorithm, beam forming algorithm, a state of the hearing device 140, etc. In some embodiments, the command(s) from the fitting device 106 may change individual state(s) and/or operation of the hearing device 140, but the change may not be persisted to a non-transitory medium (e.g., storage unit, flash, etc.) in the hearing device 140. In such cases, the change may be lost if the hearing device 140 is re-booted without saving the changes. In some embodiments, the fitting device 106 may be configured to send a command via the chat channel of the virtual fitting room 130 for causing information regarding or associated with the change of the hearing device 140 to be saved in the non-transitory medium of the hearing device 140. When the fitting device 106 received such "save" command, the fitting device 106 will then communicate with the hearing device 140 to store fitting data (corresponding with changes made to the hearing device 140 resulted from the fitting) into the non-transitory medium of the hearing device 140. In some embodiments, the "save" command itself may be considered to be an example of fitting data. Also, the change in the operation of the hearing device 140, and/or any parameters associated with such change, may also be considered as example(s) of fitting data. In some embodiments, when the fitting session is ongoing, the state of the hearing device 140 can be changed (e.g., by the fitting device 106 sending a command) to perform fitting. When the user of the hearing device 140 is satisfied with the fitting, the fitting device 106 can then send the "save" command to cause fitting data (e.g., operation parameters associated with the adjustment) to be saved to the non-transitory medium. In some embodiments, the data being stored may be formatted based on a particular hearing device model, based on one or more characteristic(s) of the hearing device (e.g., power level, functionality of component, price point, etc.).

In some embodiments, during a fitting session conducted via the virtual fitting room 130, the fitting device 106 may provide commands to change one or more states in the hearing device 140. By means of non-limiting examples, the change(s) may be a change in the fitting curve, a change in an algorithm state, etc. The commands for changing the states of the hearing device 140 may be examples of fitting data. The change(s) made to the hearing device 140 is only temporarily during the fitting session. When the health care professional of the fitting device 106 is finished with the fitting, the fitting device 106 may be operated to generate a fitting block (e.g., a block of bytes) for storage in the hearing device 140. For example, a fitting software in the fitting device 106 may generate the fitting block. The data in the fitting block may be example of fitting data. The fitting device 106 then transmits the fitting block to the end user device 112 via the chat channel of the virtual fitting room 130. After the end user device 112 receives the fitting block, it then sends it to the hearing device 140 for storage (e.g., in a flash in the hearing device 140), resulting in the fitting being saved.

As illustrated in the above embodiments, the hearing system 100 is advantageous because it allows the fitting device 106 to remotely configure the hearing device 140 via the end user device 112, without requiring the user of the hearing device 140 to be in the same geographical location as the health care professional using the fitting device 106. In particular, the fitting device 106 and the hearing device 140 may be located in different respective geographical locations, but the user of the hearing device 140 can have his/her hearing device 140 configured by the fitting device 106 remotely through the virtual fitting room 130. The hearing system 100 is also advantageous because it allows the health care professional of the fitting device 106 and the user of the hearing device 140 to interact with each other using a network connection, while the same network connection can be utilized by the fitting device 106 to remotely configure the hearing device 140.

Also, the above technique for remote configuration of the hearing device 140 does not require special changes to be made to handle the fitting of the hearing device 140. In some embodiments, the hearing system 100 may allow the fitting device 106 to use existing fitting algorithms to configure the hearing device 140, while the virtual fitting room 130 provides a transparent channel for allowing the fitting device 106 to interface with the end user device 112 and/or the hearing device 140.

In addition, the virtual fitting room 130 is advantageous because it allows the configuring of the hearing device 140 to be performed incrementally, and adjustments made on the hearing device 140 can be evaluated while the remote fitting session is ongoing using the virtual fitting room's 130 video functionality, audio functionality, chat functionality, or any combination of the foregoing. In particular, the fitting device 106 can adjust the hearing device 140 remotely, and the user of the hearing device 140 can give feedback to the health care professional of the fitting device 106 regarding the adjustment made to the hearing device 140. This allows the health care professional to further remotely configure the hearing device 140 based on the user's feedback.

In some embodiments, as shown in FIG. 1A, the hearing system 100 may optionally further include a dongle 150 configured for communication with the fitting device 106. The dongle 150 contains information that can be used to create one or more keys for encrypting and/or decrypting data being communicated between the fitting device 106 and the end user device 112. For example, the information in the dongle 150 may be a certificate that is for use to generate a challenge response for creating one or more keys for data encryption and/or decryption. In some embodiments, the information in the dongle 150 may be provided by a manufacturing of the hearing device 140. The dongle 150 may be a USB or any storage device that is configured to communicate (e.g., through a physical connector or wirelessly) with the fitting device 106.

Various techniques may be employed to generate the key(s) for encrypting and/or decrypting data being transmitted between the fitting device 106 and the end user device 112 (and/or the hearing device 140). In some embodiments, the dongle 150 may store therein a certificate. The dongle 150 may encrypt the certificate and may send it to the fitting device 106. Alternatively, the certificate in the dongle 150 may already be in encrypted form. The fitting device 106 provides the encrypted certificate to the end user device 112 and/or the hearing device 140. The end user device 112 and/or the hearing device 140 then decrypts the certificate to verify the dongle's certificate. After the dongle 150 has been verified, the dongle 150 and the end user device 112 and/or the hearing device 140 may then exchange encrypted data, and may decrypted data being exchanged. In some embodiments, the certificate in the dongle 150 may contain information that can be used by the fitting device 106 to encrypt data to be transmitted for reception by the end user device 112 and/or the hearing device. Also, in some embodiments, the certificate in the end user device 112 and/or the hearing device 140 may contain information that can be used by the end user device 112 and/or the hearing device 140 to decrypt data transmitted from the fitting device 106 via the chat channel of the virtual fitting room 130 for configuring the hearing device 140. For example, the end user device 112 and/or the hearing device 140 may use the information in the certificate to decrypt the data transmitted from the fitting device 106. As another example, the end user device 112 and/or the hearing device 140 may determine a key based on information in the certificate, and may use the key to decrypt data transmitted from the fitting device 106. Also, in some embodiments, both the dongle 150 and the hearing device 140 (and/or the end user device 112) may calculate respective keys. The key in the dongle 150 is for encrypting data to be transmitted from the fitting device 106 to the end user device 112 and/or the hearing device 140. The key in the hearing device 140 and/or the end user device 112 is for decrypting data transmitted from the fitting device 106. The calculated keys in the dongle 150 and the hearing device 140 (and/or the end user device 112) may be the same, or may be different from each other.

Also, in some embodiments, the hearing device 140 may send a randomly generated challenge together with a unique identifier for the hearing device 140, to the fitting device 106. The unique identifier may be assigned to the hearing device 140 during manufacturing process, or may be assigned after the hearing device 140 is made. The fitting device 106 and/or the dongle 150 may have a special module (with build in keys) that takes the unique identifier and generates a token based on the unique identifier using an asymmetric encryption algorithm (e.g., an AES algorithm). Alternatively or additionally, the special module may generate the token based on a public key and shared secret. The generated token proves to the hearing device 140 that a certified fitter is trying to access it, and allows setting up of a secure connection between the fitting device 106 and the hearing device 140. Once this has been set up, the hearing device 140 can be safely brought into fitting mode, thereby opening up an interface for allowing fitting data (transmitted from the fitting device 106 and received by the end user device 112) to be transmitted from the end user device 112 to the hearing device 140 using Bluetooth Low Energy. In some embodiments, the above technique may be utilized to generate the token for verifying the fitting device 106 if the hearing device 140 hasn't already been fitted by that particular fitter. If the hearing device 140 has been fitted before by the same fitter, then the hearing device 140 may store a token (generated from the previous fitting session), and may use the same token to verify the fitting device 106 for the current session. Once the fitting device 106 is verified, the fitting session can be started. Thus, in some embodiments, the fitting device 106 and/or the hearing device 140 may be configured to determine whether the current fitting session is associated with a previous fitting session (e.g., whether the hearing device 140 was previously fitted by the same fitting device 106 or by the same health care profession), and if so, the current fitting session can be started.

In other embodiments, the dongle 150 is not required, and the fitting device 106 may be configured to use a service for obtaining key(s) for data encryption and/or data decryption.

In the above embodiments, the hearing system 100 is described as having the fitting device 106 send the first information to the electronic device 104. In other embodiments, instead of the fitting device 106 sending the first information to the electronic device 104 to initiate the request for connection bridge, the end user device 112 may be configured to send the first information. Thus, in other embodiments, the arrow 1 in FIG. 1A may be leading from the end user device 112 to the electronic device 104. In particular, the end user device 112 may generate and send first information to the electronic device 104. The generation of the first information may be performed based on an input received at the end user device 112. For example, the user using the end user device 112 may operate a user input (e.g., a physical button, input device, graphical user interface, etc.) at the end user device 112 to cause the end user device 112 to send the first information. As another example, the end user device 112 may send the first information to the electronic device 104 in response to an input transmitted to the end user device 112 from another device (e.g., the hearing device 140). The first information may relate to a request for establishing a communication between the fitting device 106 and the end user device 112.

Figure 2:
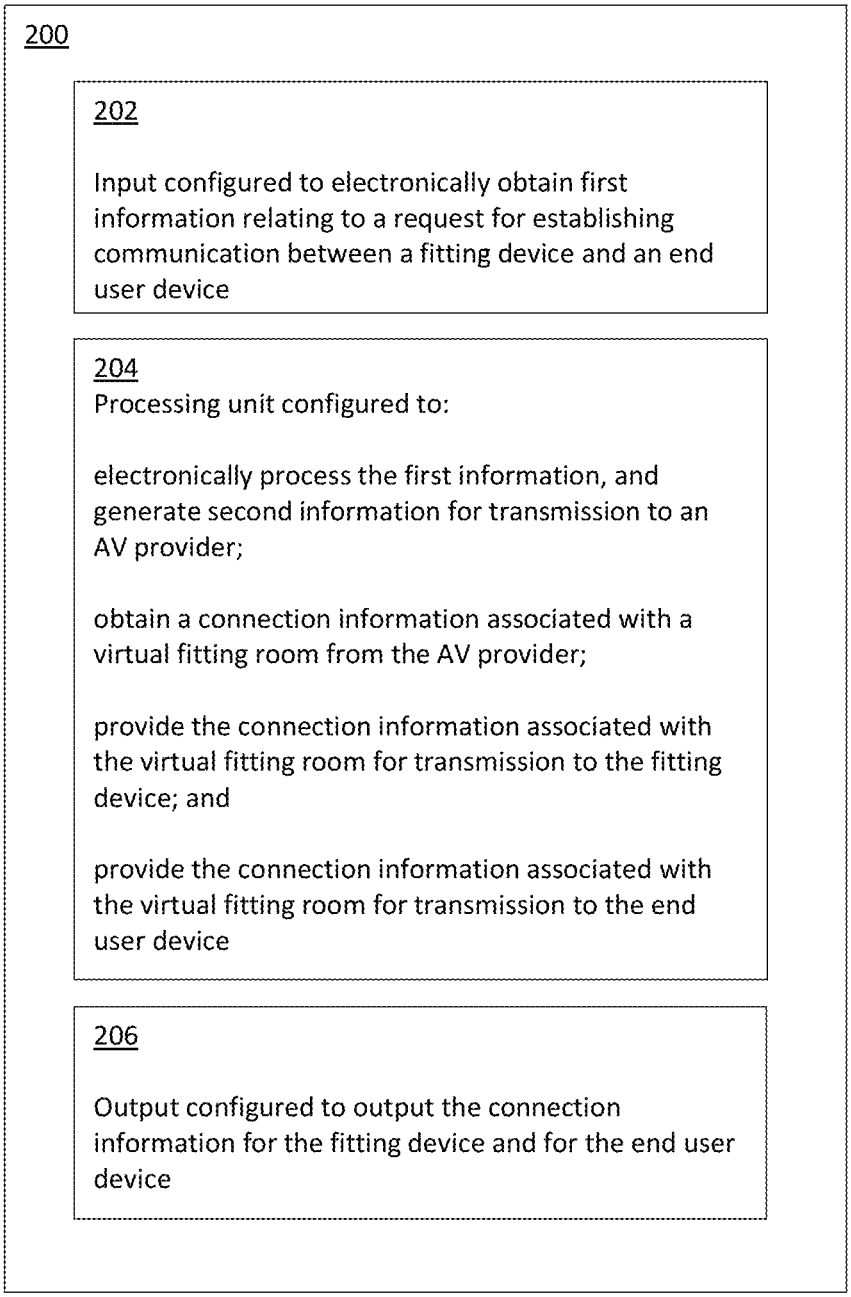
FIG. 2 illustrates an example of the electronic device of FIG. 1A in accordance with some embodiments.

FIG. 2 illustrates an electronic device 200 in accordance with some embodiments. The electronic device 200 may be an example of the electronic device 104 of FIG. 1A. The electronic device 200 of FIG. 2 is configured to assist formation of a communication link for allowing the fitting device 106 and the end user device 112 to communicate with each other. The electronic device 200 includes an input 202 configured to electronically obtain first information relating to a request for establishing communication between the fitting device 106 and the end user device 112. The electronic device 200 also includes a processing unit 204 configured to electronically process the first information, and provide second information for transmission to an AV provider, obtain a connection information associated with a virtual fitting room from the AV provider, provide the connection information associated with the virtual fitting room for the fitting device, and provide the connection information associated with the virtual fitting room for transmission to the end user device. The electronic device 200 further includes an output 206 configured to output the connection information for the fitting device and for the end user device.

In some embodiments, the connection information associated with the virtual fitting room 130 is configured to allow the fitting device 106 and the end user device 112 to communicatively connect with each other.

In some embodiments, the first information comprises a request for the connection information, a request to set up a virtual meeting, a request for a session, a request for handshake, or a request that will lead to an establishment or that will assist in an establishment, of a communication bridge between the fitting device 106 and the end user device 112.

In some embodiments, the second information comprises a request for the connection information, a request to set up a virtual meeting, a request for a session, a request for handshake, or a request that will lead to an establishment or that will assist in an establishment, of a communication bridge between the fitting device 106 and the end user device 112.

In some embodiments, the second information is the same as the first information.

In some embodiments, the connection information comprises a virtual fitting room identification.

In some embodiments, the processing unit 204 of the electronic device 200 is also configured to obtain a first caller identification for the fitting device 106 and a second caller identification for the end user device 112.

Optionally, the processing unit 204 of the electronic device 200 is also configured to provide the first caller identification for transmission to the fitting device 106, and to provide the second caller identification for transmission to the end user device 112.

In some embodiments, the electronic device 200 comprises a server that is configured to communicate with the fitting device 106, the AV provider 108, and the notification server 110 that is configured to provide VoIP message for the end user device 112.

The processing unit 204 of the electronic device 200 may include hardware, software, or a combination of both. By means of non-limiting examples, hardware of the processing unit 204 may include one or more processors and/or one or more integrated circuits. In some embodiments, the processing unit 204 may be implemented as a module and/or may be a part of any integrated circuit.

The input 202 of the electronic device 200 may be an input that interfaces with external devices, or may be an input internal to the electronic device 200 that is configured to communicate with a component in the electronic device 200. In some embodiments, the input 202 may be any communication interface, such as any hardware interface and/or software interface. Also, in some embodiments, the input 202 may include an antenna, or may be a part of a communication device configured to receive data.

The output 206 of the electronic device 200 may be an output that interfaces with external devices, or may be an output internal to the electronic device 200 that is configured to communicate with a component in the electronic device 200. In some embodiments, the output 206 may be any communication interface, such as any hardware interface and/or software interface. In some embodiments, the output 206 may be configured to provide data to another device, such as to the fitting device 106, to the AV device 108, to a server, to a storage unit (e.g., a local memory and/or a remote storage unit), etc. Additionally or alternatively, the output 206 may be configured to provide data to another processing unit for further processing of the data. Additionally or alternatively, the output 206 may be configured to provide data to a communication unit for communicating the data to another device (e.g., wirelessly or via a cable).

The electronic device 200 may be any device, or may be implemented in any device. In some embodiments, the electronic device 200 may be any of a stationary device or a handheld device capable of providing signal communication, or may be a component (hardware component and/or software component) of a stationary device or a component of a handheld device. By means of non-limiting examples, the electronic device 200 may be a computer, a laptop, a tablet, a mobile phone, a terminal, a server, or any component (hardware and/or software) of the foregoing. In some embodiments, the electronic device 200 may associated with (e.g., owned, controlled by, in relation with, etc.) a hearing device manufacturer, or associated with a hearing professional. In still further embodiments, the electronic device 200 may be a hearing professional device (such as the fitting device 106), or may be implemented as a part of the hearing professional device.

In some embodiments, the electronic device 200 may also include a non-transitory medium storing data. For example, the non-transitory medium may be configured to store information provided by the fitting device 106, connection information obtained by the electronic device 200, and/or any information provisioned by the electronic device 200.

Figure 3:
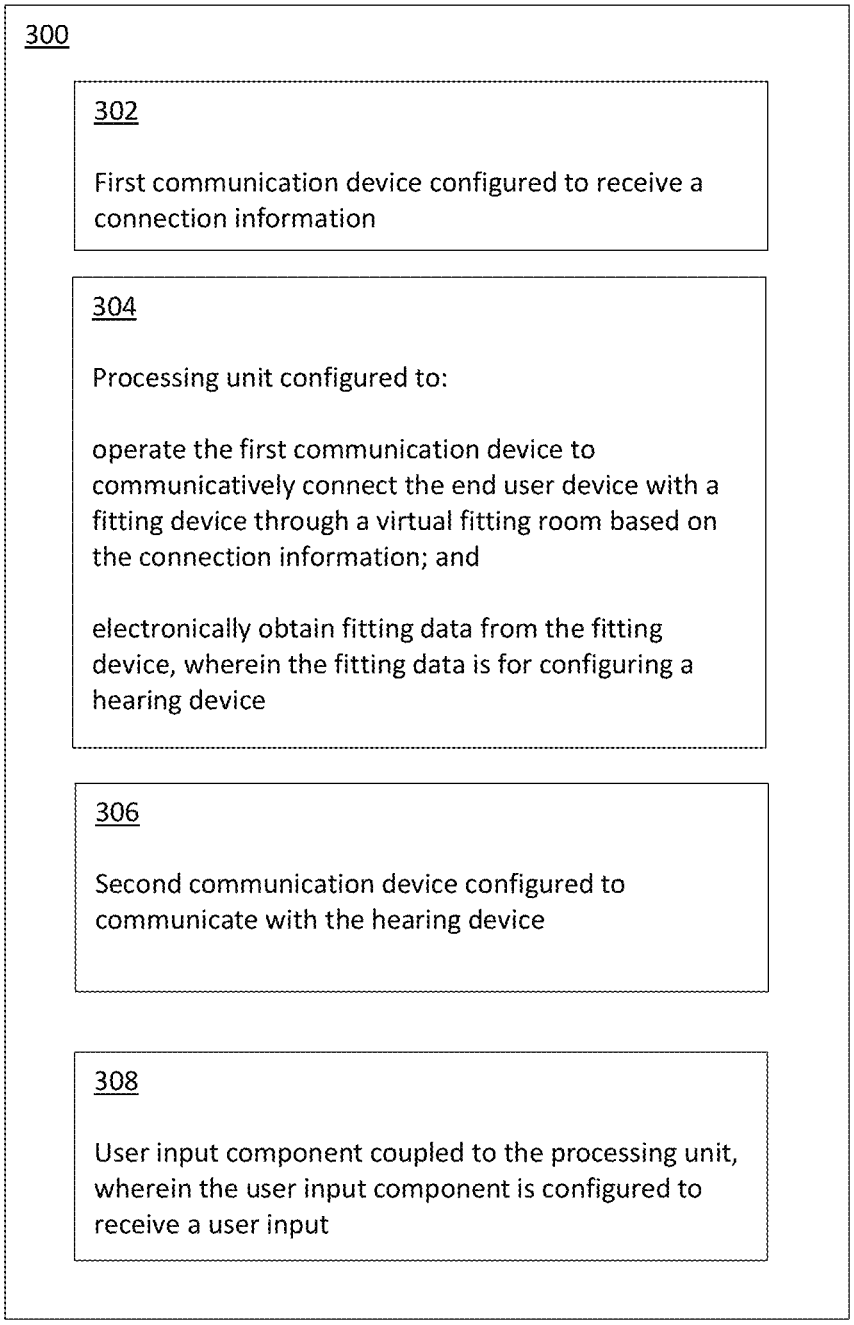
FIG. 3 illustrates an example of the end user device of FIG. 1A in accordance with some embodiments.

FIG. 3 illustrates an example of an end user device 300. The end user device 300 may be an example of the end user device 112 of FIG. 1A in some embodiments. The end user device 300 is configured to communicate with a hearing device (e.g., the hearing device 140) in order to configure the hearing device. In some embodiments, the end user device 300 is configured to obtain fitting data transmitted from a fitting device through a virtual chat room, and configure the hearing device based on the fitting data.

The end user device 300 of FIG. 3 includes a first communication device 302 configured to receive a connection information. The end user device 300 also includes a processing unit 304 configured to operate the first communication device to communicatively connect the end user device with a fitting device through a virtual fitting room based on the connection information, and electronically obtain fitting data from the fitting device, wherein the fitting data is for configuring a hearing device. The end user device 300 further includes a second communication device 306 configured to communicate with a hearing device (e.g., the hearing device 140).

The processing unit 304 of the end user device 300 may include hardware, software, or a combination of both. By means of non-limiting examples, hardware of the processing unit 304 may include one or more processors and/or one or more integrated circuits. In some embodiments, the processing unit 304 may be implemented as a module and/or may be a part of any integrated circuit.

The first communication device 302 of the electronic device 200 may be an antenna and/or a transceiver configured to provide wireless communication in some embodiments. In other embodiments, the first communication device 302 may be a communication connector configured to couple to a cable for providing wired communication. In further embodiments, the first communication device 302 may be an input that interfaces with external devices, or may be an input internal to the end user device 300 that is configured to communicate with a component in the end user device 300. In some embodiments, the input may be any communication interface, such as any hardware interface and/or software interface.

The second communication device 306 of the electronic device 200 may be an antenna and/or a transceiver configured to provide wireless communication in some embodiments. In other embodiments, the second communication device 306 may be a communication connector configured to couple to a cable for providing wired communication. In further embodiments, the second communication device 306 may be an output that interfaces with external devices, or may be an output internal to the end user device 300 that is configured to communicate with a component in the end user device 300. In some embodiments, the output may be any communication interface, such as any hardware interface and/or software interface.

In some embodiments, the first communication device 302 may be configured to provide long range communication, and the second communication device 306 may be configured to provide short range communication (that is shorter than the long range communication of the first communication device 302). In one implementation, the second communication device 306 may be a Bluetooth component configured to provide Bluetooth communication. In such cases, the first communication device 302 may be configured to provide long range communication that is longer than the Bluetooth communication. In other embodiments, the first communication device 302 and the second communication device 306 may be integrated as a single component. For example, the first communication device 302 and the second communication device 306 may together form parts of a communication interface or a communication component (e.g., a transceiver). In further embodiments, the first communication device 302 may be a first software interface, and the second communication device 306 may be a second software interface.

As shown in FIG. 3, the end user device 300 also includes a user input component 308 coupled to the processing unit 304. The user input component 308 is configured to receive a user input. By means of non-limiting examples, the user input component 308 may be a touchscreen, one or more buttons, one or more knobs, one or more switches, a keyboard, a mouse, a touchpad, a trackball, a graphical interface through which a user can enter one or more input, or any device and/or application that is capable of receiving user input. It should be noted that the user input component 308 is not limited to a physical user input component, and that the input component 308 may be a graphical user interface implemented using software in other embodiments.

The end user device 300 may be any device, or may be implemented in any device. In some embodiments, the end user device 300 may be any of a stationary device or a handheld device capable of providing signal communication. By means of non-limiting examples, the end user device 300 may be a computer, a laptop, a tablet, a mobile phone, a terminal, a server, a remote control, a charger, or any component (hardware and/or software) of the foregoing. In some embodiments, the end user device 300 may be owned and used by the user of the hearing device 140.

In some embodiments, the processing unit 304 of the end user device 300 is configured to configure the hearing device 140 via the second communication device 306.

In some embodiments, the end user device 300 is configured to communicate with the fitting device 106 and/or receive data from the fitting device 106 via a chat channel of the virtual fitting room 130.

In some embodiments, the processing unit 304 of the end user device 300 comprises an interpreter; and wherein the processing unit 304 is configured to electronically obtain the data from the fitting device 106 via the chat channel, and wherein the interpreter is configured to determine whether the data is fitting data.

In some embodiments, the end user device 300 is configured to configure the hearing device 140 based on the fitting data by transmitting the fitting data to the hearing device 140.

In some embodiments, the connection information comprises a virtual fitting room identification, and the end user device 300 is configured to obtain a caller identification associated with the end user device 300, and wherein the processing unit 304 of the end user device 300 is configured to operate the first communication device 302 to communicatively connect the end user device 300 with the fitting device 106 through the virtual fitting room 130 based on both the virtual fitting room identification and the caller identification.

In some embodiments, the end user device 300 is configured to receive the connection information from the notification server 110. In some embodiments, the connection information is a part of a VoIP message provided by the notification server 110.

In some embodiments, the fitting data obtained by the end user device 300 comprises hearing aid fitting data.

In some embodiments, the end user device 300 comprises a cellular phone, a tablet, a computer, a laptop, a handheld device, or a remote control.

Figure 4:
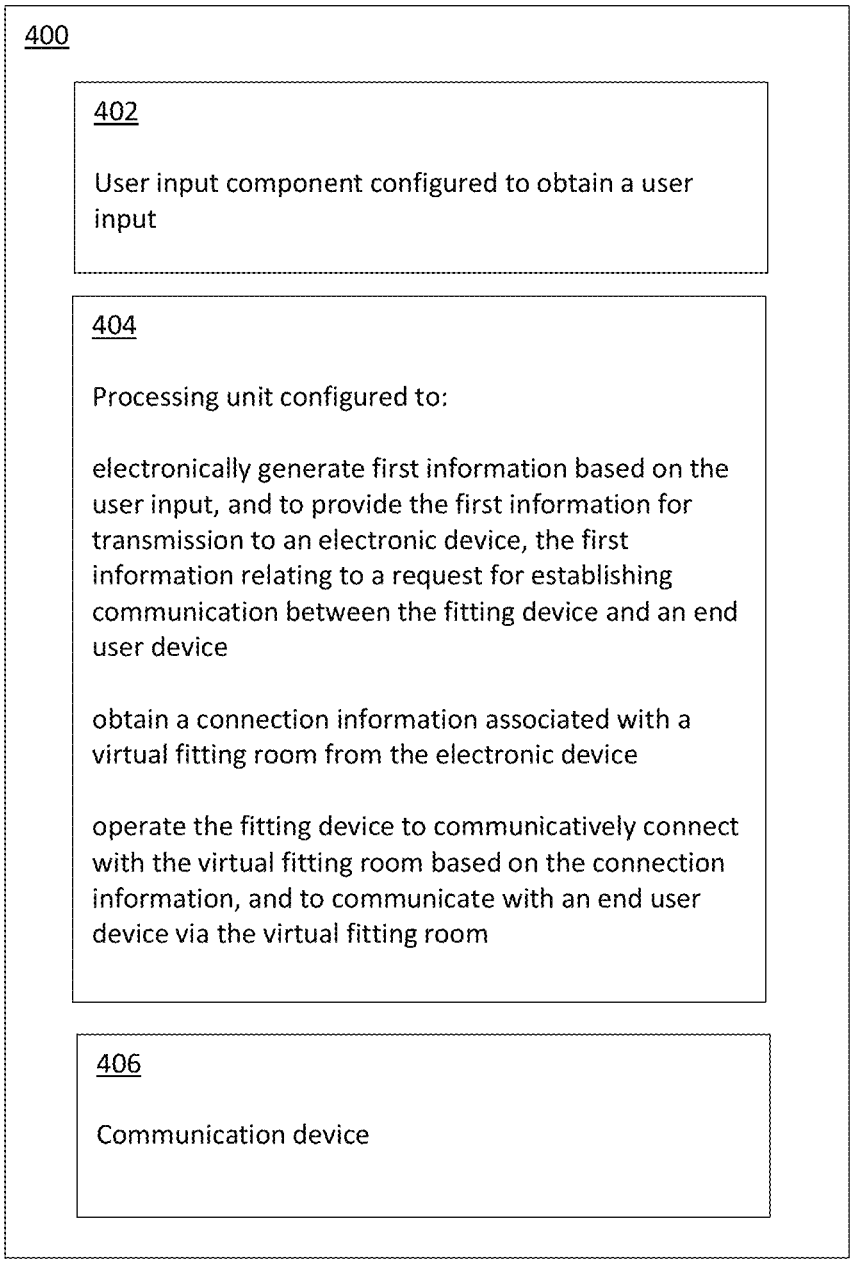
FIG. 4 illustrates an example of the fitting device of FIG. 1A in accordance with some embodiments.

FIG. 4 illustrates an example of a fitting device 400. The fitting device 400 may be an example of the fitting device 106 of FIG. 1A in some embodiments. The fitting device 400 is configured to provide fitting data for configuring a hearing device (e.g., the hearing device 140). As used in this specification, the term "fitting data" may refer to one or more of: command, state identification, program selection, fitting parameter(s), any information that may affect the manner in which the hearing device process sound, etc. In some embodiments, the fitting data may be based on a hearing loss and/or hearing preference of a user of the hearing device. In such cases, the fitting device 400 may be configured to receive one or more input indicating hearing characteristic(s) (e.g., hearing loss characteristic, hearing preference, etc.) of the user, and generate the fitting data based on the input.

The fitting device 400 of FIG. 4 includes a user input component 402 configured to obtain a user input. The fitting device 400 also includes a processing unit 404 configured to (1) electronically generate first information based on the user input, and to provide the first information for transmission to an electronic device, the first information relating to a request for establishing communication between the fitting device and an end user device, (2) obtain a connection information associated with a virtual fitting room from the electronic device, and (3) operate the fitting device to communicatively connect with the virtual fitting room based on the connection information, and to communicate with an end user device via the virtual fitting room. The fitting device 400 further includes a communication device 406 configured to communicate with one or more other devices.

The user input component 402 may be an input that interfaces with external device(s), or may be an input internal to the fitting device 400 that is configured to communicate with a component in the fitting device 400. In some embodiments, the user input component may be any communication interface, such as any hardware interface and/or software interface. Also, in some embodiments, the user input component 402 may include an antenna and/or a transceiver for wireless communication. In other embodiments, the user input component 402 may be a connector configured to provide wired communication. In further embodiments, the user input component 402 may be a part of a communication device configured to receive data.

The processing unit 404 of the fitting device 400 may include hardware, software, or a combination of both. By means of non-limiting examples, hardware of the processing unit 404 may include one or more processors and/or one or more integrated circuits. In some embodiments, the processing unit 404 may be implemented as a module and/or may be a part of any integrated circuit.

The fitting device 400 may be any device, or may be implemented in any device. In some embodiments, the fitting device 400 may be any of a stationary device or a handheld device capable of providing signal communication. By means of non-limiting examples, the fitting device 400 may be a computer, a laptop, a tablet, a mobile phone, a terminal, a server, or any component (hardware and/or software) of the foregoing. In some embodiments, the electronic device 400 may include one or more fitting applications (e.g., computer program(s), code, module(s), etc.) for providing fitting functionalities. The fitting application(s) may be provided by a manufacturer of the hearing device 140, by another hearing device manufacturer, by a software developer, by a health care provider, etc.

In some embodiments, the fitting device 400 is configured to communicate with the end user device 112 via a chat channel of the virtual fitting room 130.

In some embodiments, the processing unit 404 of the fitting device 400 is configured to provide fitting data for transmission to the end user device 112 via the chat channel.

In some embodiments, the fitting data provided by the fitting device 400 comprises hearing aid fitting data.

In some embodiments, the processing unit 404 of the fitting device 400 is also configured to generate a control signal for transmission via the chat channel, wherein the control signal is configured to cause the end user device 112 to configure the hearing device 130.

In some embodiments, the connection information comprises a virtual fitting room identification, and the fitting device 400 is configured to obtain a caller identification associated with the fitting device 106, and wherein the processing unit 404 of the fitting device 400 is configured to operate the communication device 406 to communicatively connect the fitting device 106 with the end user device 112 through the virtual fitting room 130 based on both the virtual fitting room identification and the caller identification.

In some embodiments, the caller identification may be a part of the connection information.

In some embodiments, the electronic device 200, the fitting device 300, and the end user device 400 may form a hearing system. In particular, the hearing system includes: the electronic device 200; the fitting device 300; and the end user device 400, wherein the end user device 400 is configured to configure a hearing device; (1) wherein the electronic device 200 comprises: an input configured to electronically obtain first information relating to a request for establishing communication between the fitting device and the end user device, the end user device being configured to configure the hearing device based on fitting data from the fitting device; and a first processing unit configured to electronically process the first information, and provide second information for transmission to an AV provider; wherein the first processing unit is also configured to obtain a connection information associated with a virtual fitting room from the AV provider, and provide the connection information associated with the virtual fitting room for the fitting device; and wherein the first processing unit is also configured to provide the connection information associated with the virtual fitting room for transmission to the end user device; (2) wherein the end user device 300 comprises: a communication device configured to receive the connection information; a second processing unit configured to operate the communication device to communicatively connect the end user device with the fitting device through the virtual fitting room based on the connection information; and an end-user-device user input component coupled to the second processing unit; wherein the second processing unit is also configured to electronically obtain the fitting data from the fitting device, and wherein the end user device is configured to configure the hearing device based on the fitting data; and (3) wherein the fitting device 400 comprises: a fitting-device user input component configured to obtain a user input; and a third processing unit configured to electronically generate the first information based on the user input, and to provide the first information for transmission to the electronic device, the first information relating to the request for establishing communication between the fitting device and the end user device, the end user device being configured to configure the hearing device; wherein the third processing unit is also configured to obtain the connection information associated with the virtual fitting room from the electronic device; and wherein the fitting device 400 is configured to communicatively connect with the virtual fitting room based on the connection information, and to communicate with the end user device via the virtual fitting room.

Figure 5:
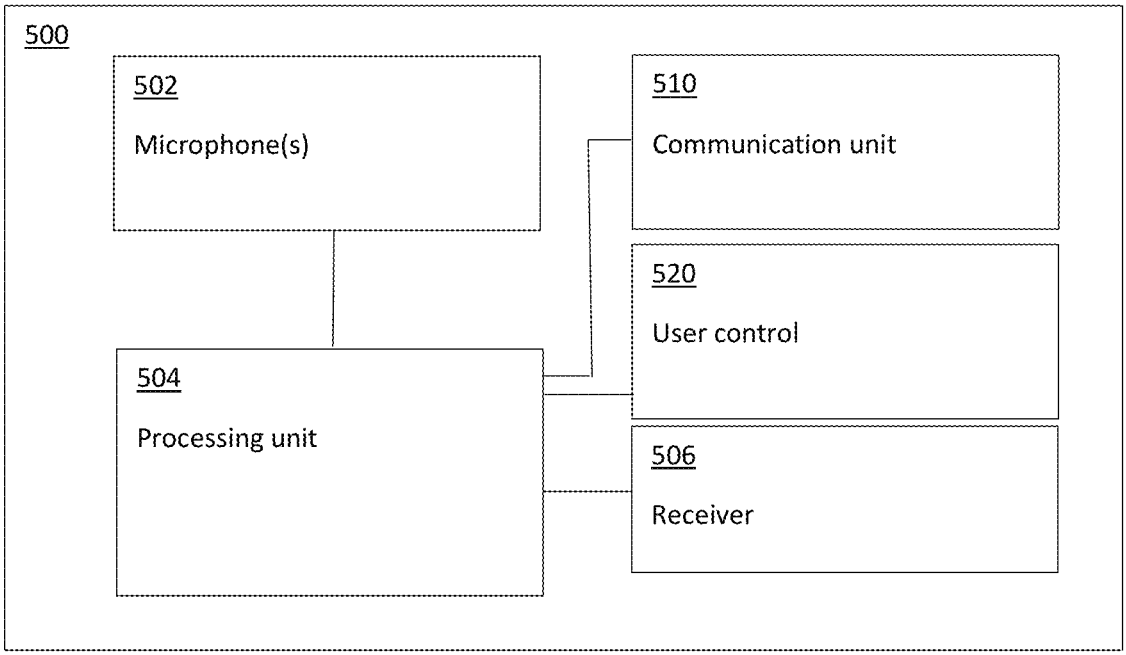
FIG. 5 illustrates an example of the hearing device of FIG. 1A in accordance with some embodiments.

FIG. 5 illustrates an example of a hearing device 500. The hearing device 500 may be an example of the hearing device 140 of FIG. 1A in some embodiments. The hearing device 500 includes one or more microphones 502, a processing unit 504, a receiver 506, a communication unit 510, and a user control 520. In some embodiments, the hearing device 500 may be a hearing aid configured to compensate for a hearing loss of a user. In such cases, the processing unit 504 may include a hearing loss compensation unit. The processing unit 504 may be a processor, an integrated circuit, an application, functional module, etc. The microphone(s) 502 is configured to receive sound from an environment outside the user of the hearing device 500, and generate microphone signals based on the received sound. The processing unit 504 is configured to perform signal processing to compensate for a hearing loss of the user, and to generate an output based on the microphone signals from the microphone(s) 502. The receiver 506 is configured to generate sound for reception by an eardrum of the user based on the output from the processing unit 504. The communication unit 510 is configured to communicate with one or more devices, such as another hearing device of the user, an accessory device, a server, a hearing professional device, etc. The communication unit 510 may be one or more wireless communication units and/or one or more cable connectors. In some embodiments, the communication unit 510 may include one or more antennas. The user control 520 may be one or more buttons, one or more knobs, one or more switches, or any combination of the foregoing. The user control 520 is configured to allow the user of the hearing device 20 to control an operation of the hearing device 500. For example, the user may operate the user control 520 to adjust a volume of sound, to change an operation mode of the hearing device 500, to change a hearing program of the hearing device 500, to change an operation parameter of the hearing device 500, etc.

The hearing device 500 may be a hearing aid, such as an in-the-canal (ITC) hearing aid, a completely-in-canal (CIC) hearing aid, an invisible-in-the-canal (IIC) hearing aid, a receiver-in-the-ear (RITE) hearing aid, a receiver-in-canal (RIC) hearing aid, microphone-and-receiver-in-ear (MaRIE), etc.

Also, in some embodiments, there may be two hearing devices 500 for respective ears of the user. In such cases, the hearing device 140 of FIG. 1A may include a left hearing instrument and a right hearing instrument. Accordingly, the term "hearing device" may refer to one or more hearing instruments.

In other embodiments, the hearing device 500 may not be a hearing aid. Instead, the hearing device 500 may be a headset, an earbud, a hearing protection device, etc. In some embodiments, the hearing device 500 may not include any hearing loss compensation unit. In other embodiments, the hearing device 500 may include a processing unit configured to provide signal processing related to a hearing of the user. For example, the processing unit may be configured to perform noise reduction, noise cancellation, speech recognition, bass adjustment, treble adjustment, fad balancing, processing of user input, etc.

It should be noted that the hearing system 100 is not limited to the example described, and that the hearing system 100 may have other configurations in other embodiments. In other embodiments two or more of the devices described with reference to the hearing system 100 may be combined.

Figure 6:
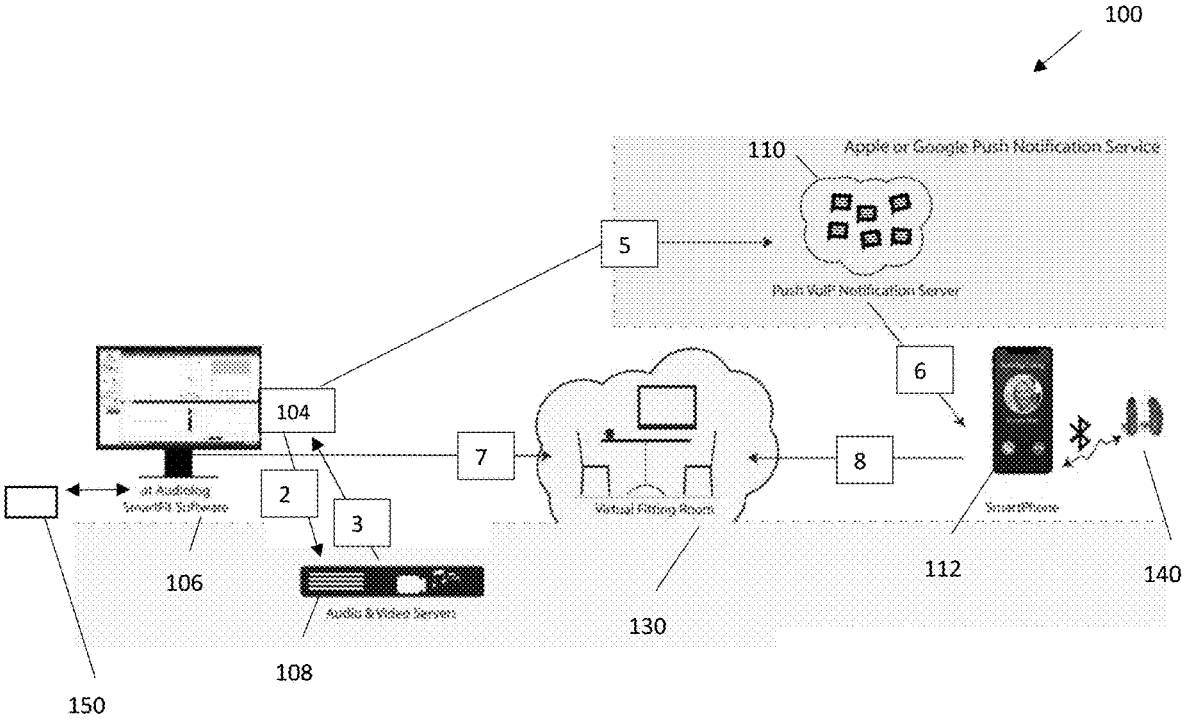
FIG. 6 illustrates a hearing system that includes an electronic device, a fitting device, and an end user device configured to configure a hearing device in accordance with some embodiments.

For example, in other embodiments, the electronic device 104 may be integrated with the fitting device 106, or the electronic device 104 may be implemented as a component of the fitting device 106. In one implementation, the electronic device 104 may be an application installed in the fitting device 106. In such cases, such application may be configured to cooperate with a fitting software installed in the fitting device 106. Alternatively, such application may be implemented as a part of a fitting software in the fitting device 106. FIG. 6 illustrates a hearing system 100 that includes an electronic device 104, a fitting device 106, and an end user device 112 configured to configure a hearing device 140 in accordance with some embodiments. The hearing system 100 of FIG. 6 is the same as that of FIG. 1A, except that the electronic device 104 is implemented as a part of the fitting device 106. The electronic device 104 may be a hardware component (e.g., a processor, a part of a processor, or an integrated circuitry, etc.) in the fitting device 106, and/or may be a software (e.g., an application, software module, etc.) in the fitting device 106. During use, the fitting device 106 provides first information as input for the electronic device 104 (which corresponds with arrow 1 in FIG. 1A, but is not shown in FIG. 6 because such signal path is internal to the fitting device 106). The input may be transmitted from another device and received by the fitting device. Alternatively, the input may be generated by a user input interface at the fitting device. The electronic device 104 then processes the first information and provides second information for reception by the AV provider 108 (see arrow 2), as similarly discussed with reference to FIG. 1A. In the hearing system of FIG. 6, the AV provider 108 then processes the second information, obtains connection information, and provides the connection information to the electronic device 104 in the fitting device 106 (see arrow 3), as similarly discussed with reference to FIG. 1A. In the hearing system of FIG. 6, the electronic device 104 provides the connection information for the fitting device to perform further processing (e.g., storing) of the connection information (which corresponds with arrow 4 in FIG. 1A, but is not shown in FIG. 6 because such signal path is internal to the fitting device 106). In the hearing system of FIG. 6, the electronic device 104 then provides the connection information to the notification server 110 (see arrow 5), which sends notification to the end user device 112 (see arrow 6), as similarly discussed with reference to FIG. 1A. In the hearing system of FIG. 6, the fitting device 106 and the end user device 112 connect to the virtual fitting room 130 (see arrows 7, 8), which provides one or more communication channel for the fitting device 106 and the end user device 112 to communicate with each other in a fitting session, and for the fitting device 106 to provide fitting data for configuring the hearing device 140, as similarly discussed with reference to FIG. 1A. It should be noted that in the embodiments of FIG. 6, because the electronic device 104 and the fitting device 106 are integrated, any feature (e.g., functionality, processing item, etc.) described with reference to electronic device 104 may also apply for the fitting device 106, or vice versa.

In another example, the electronic device 104 may be integrated with the AV provider 108, or the electronic device 104 may be implemented as a component of the AV provider 108. In one implementation, the electronic device 104 may be an application installed in the AV provider 108. In such cases, such application may be configured to cooperate with one or more software modules in the AV provider 108. It should be noted that in the embodiments in which the electronic device 104 and the AV provider 108 are integrated, any feature (e.g., functionality, processing item, etc.) described with reference to electronic device 104 may also apply for the AV provider 108, or vice versa.

In a further example, both the electronic device 104 and the AV provider 108 may be integrated with the fitting device 106, or may be implemented as components of the fitting device 106. In one implementation, the electronic device 104 and the AV provider 108 may be respective software modules (e.g., applications) configured to interact with the fitting software in the fitting device 106. It should be noted that in the embodiments in which the electronic device 104, the fitting device 106, and the AV provider 108 are integrated, any feature (e.g., functionality, processing item, etc.) described with reference to electronic device 104 may also apply for the fitting device 106 and/or the AV provider 108, any feature described with reference to the fitting device 106 may also apply for the electronic device 104 and/or the AV provider 108, and any feature described with reference to the AV provider 108 may also apply for the electronic device 104 and the fitting device 106.

Figure 7:
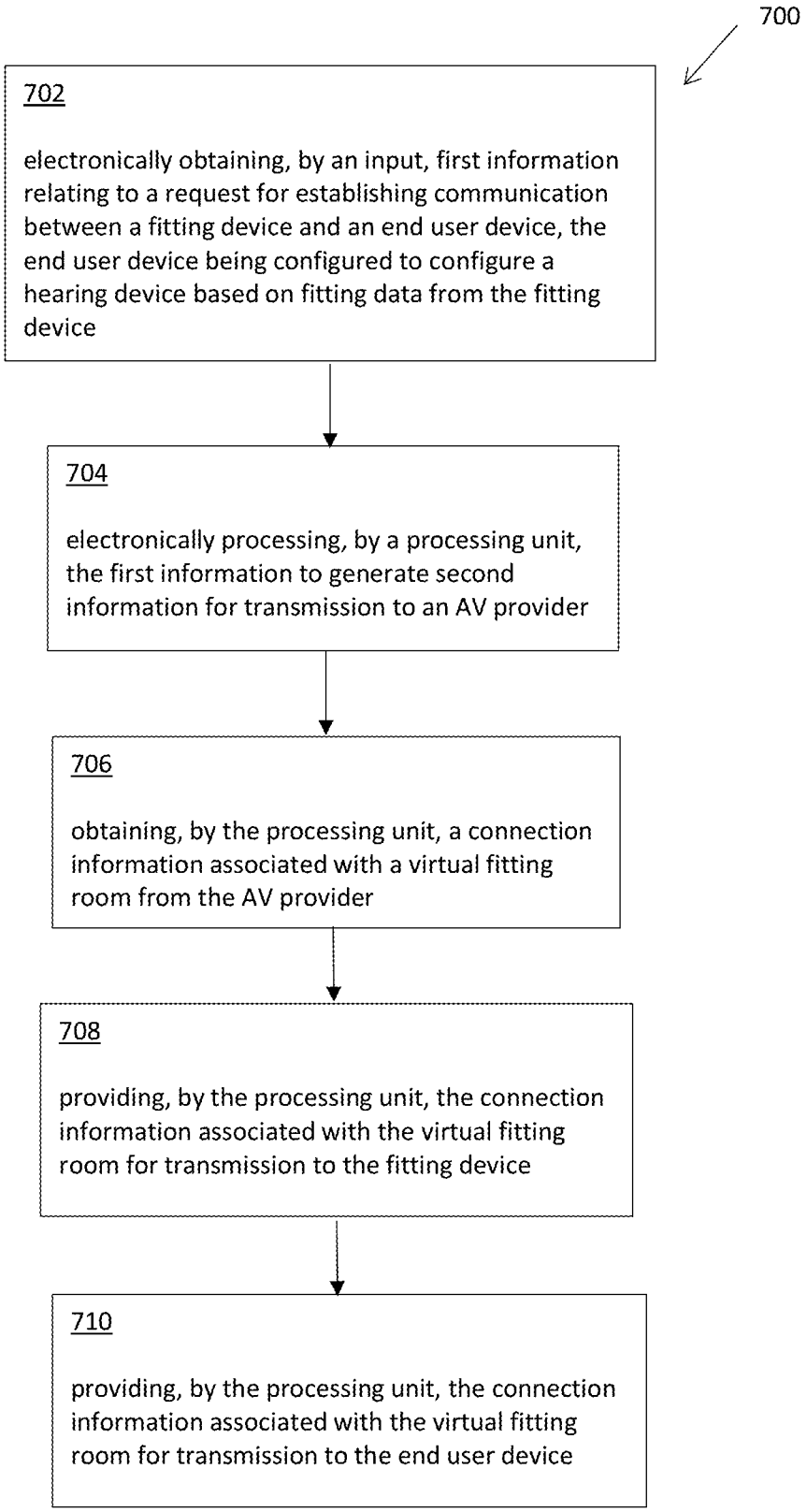
FIG. 7 illustrates an example of a method performed by the electronic device of FIG. 2.

FIG. 7 illustrates a method 700 performed by an electronic device (e.g., the electronic device 104/200). The method 700 includes electronically obtaining, by an input, first information relating to a request for establishing communication between a fitting device and an end user device, the end user device being configured to configure a hearing device based on fitting data from the fitting device (item 702). The method 700 also includes: electronically processing, by a processing unit, the first information to generate second information for transmission to an AV provider (item 704), obtaining, by the processing unit, a connection information associated with a virtual fitting room from the AV provider (item 706), providing, by the processing unit, the connection information associated with the virtual fitting room for the fitting device (item 708), and providing, by the processing unit, the connection information associated with the virtual fitting room for transmission to the end user device (item 710).

Optionally, in the method 700, the connection information associated with the virtual fitting room is configured to allow the fitting device and the end user device to communicatively connect with each other.

Optionally, in the method 700, the first information comprises a request for the connection information, a request to set up a virtual meeting, a request for a session, a request for handshake, or a request that will lead to an establishment or that will assist in an establishment, of a communication bridge between the fitting device and the end user device.

Optionally, in the method 700, the second information comprises a request for the connection information, a request to set up a virtual meeting, a request for a session, a request for handshake, or a request that will lead to an establishment or that will assist in an establishment of a communication bridge between the fitting device and the end user device.

Optionally, in the method 700, the second information is the same as the first information.

Optionally, in the method 700, the connection identification comprises a virtual fitting room identification.

Optionally, the method 700 further comprises obtaining a first caller identification for the fitting device, and providing the first caller identification for transmission to the fitting device.

Optionally, the method 700 further comprises obtaining a second caller identification for the end user device, and providing the second caller identification for transmission to the end user device.

Optionally, the electronic device comprises a server that is configured to communicate with the fitting device, the AV provider, and a notification server that is configured to provide VoIP message for the end user device.

Figure 8:
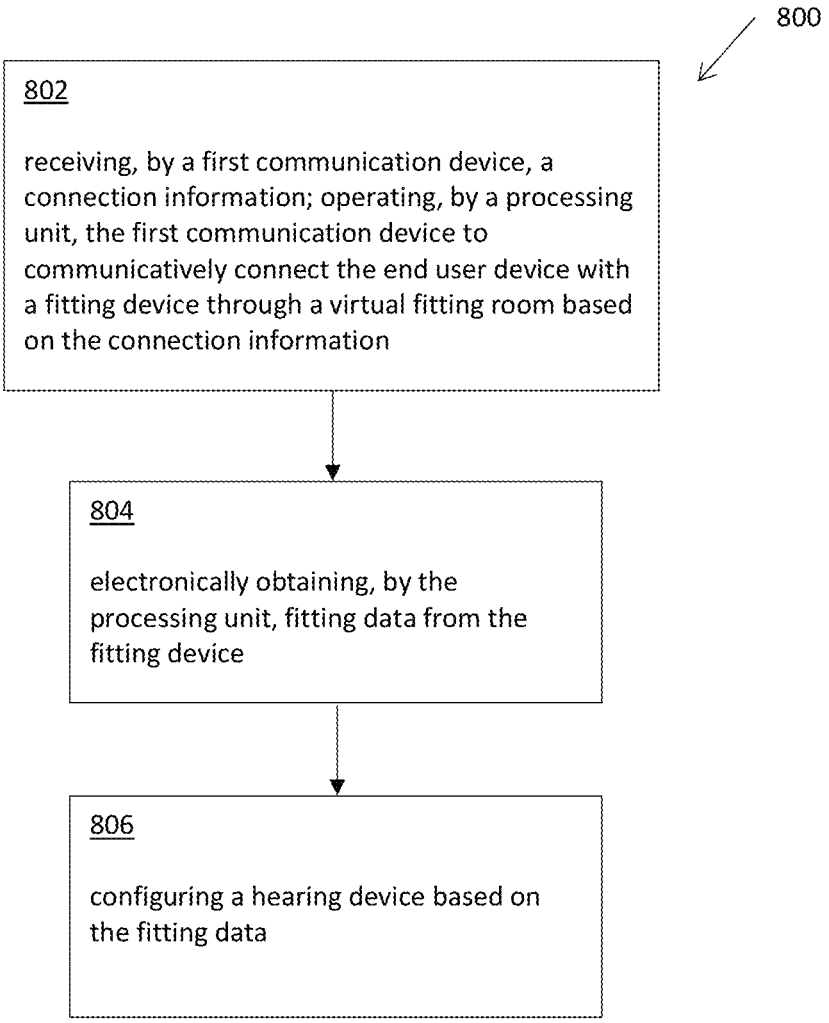
FIG. 8 illustrates an example of a method performed by the end user device of FIG. 3.

FIG. 8 illustrates a method 800 performed by an end user device (e.g., the end user device 112/300). The method 800 includes receiving, by a first communication device, a connection information; operating, by a processing unit, the first communication device to communicatively connect the end user device with a fitting device through a virtual fitting room based on the connection information (item 802). The method 800 also includes electronically obtaining, by the processing unit, fitting data from the fitting device (item 804), and configuring a hearing device based on the fitting data (item 806).

Optionally, the method 800 further comprises configuring the hearing device by communicating with the hearing device via a second communication device.

Optionally, the method 800 further comprises communicating with the fitting device and/or receiving data from the fitting device via a chat channel of the virtual fitting room.

Optionally, in the method 800, the act of electronically obtaining the fitting data comprises electronically obtaining the fitting data from the fitting device via the chat channel.

Optionally, the method 800 further comprises configuring the hearing device based on the fitting data by transmitting the fitting data to the hearing device.

Optionally, in the method 800, the connection information comprises a virtual fitting room identification and a caller identification associated with the end user device, and wherein the first communication device is operated by the processing unit to communicatively connect the end user device with the fitting device through the virtual fitting room based on both the virtual fitting room identification and the caller identification.

Optionally, in the method 800, the connection information is received from a notification server.

Optionally, in the method 800, the connection information is a part of a VoIP message provided by the notification server.

Optionally, in the method 800, the fitting data comprises hearing aid fitting data.

Optionally, in the method 800, the end user device comprises a cellular phone, a tablet, a computer, a laptop, a handheld device, or a remote control.

Figure 9:
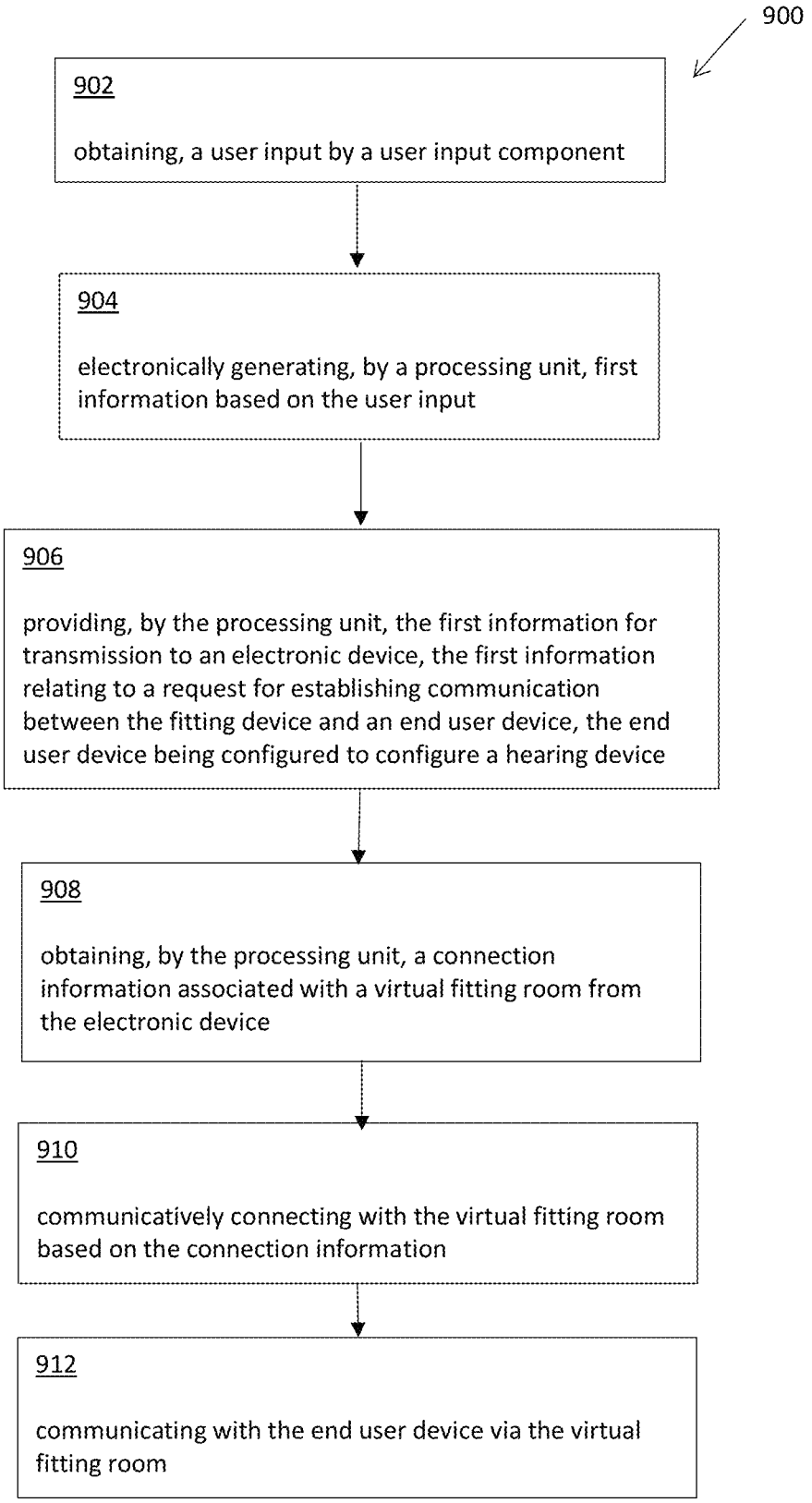
FIG. 9 illustrates an example of a method performed by the fitting device of FIG. 4.

FIG. 9 illustrates a method 900 performed by a fitting device (e.g., the fitting device 106/400). The method 900 includes: obtaining, a user input by a user input component (item 902), and electronically generating, by a processing unit, first information based on the user input (item 904). The method 900 also includes providing, by the processing unit, the first information for transmission to an electronic device, the first information relating to a request for establishing communication between the fitting device and an end user device, the end user device being configured to configure a hearing device (item 906). The method 900 further includes: obtaining, by the processing unit, a connection information associated with a virtual fitting room from the electronic device (item 908), communicatively connecting with the virtual fitting room based on the connection information (item 910), and communicating with the end user device via the virtual fitting room (item 912).

Optionally, in the method 900, the act of communicating with the end user device is performed by the fitting device via a chat channel of the virtual fitting room.

Optionally, the method 900 further comprises providing, by the processing unit, fitting data for transmission to the end user device via the chat channel.

Optionally, in the method 900, the fitting data comprises hearing aid fitting data.

Optionally, the method 900 further comprises generating a control signal, by the processing unit, for transmission via the chat channel, wherein the control signal is configured to cause the end user device to configure the hearing device.

Optionally, in the method 900, the connection information comprises a virtual fitting room identification and a caller identification for the fitting device, and wherein the communication device is operated to communicatively connect the fitting device with the end user device through the virtual fitting room based on both the virtual fitting room identification and the caller identification.

It should be noted that as used in this specification, the term "device" or any phrase including such term (e.g., electronic device, end user device, fitting device, etc.) may refer to a tangible item that includes at least some hardware (such as a processor, a circuit, an electronic component, etc.), may refer to software (e.g., an application, a program, coding, etc.), or may refer to a combination of both hardware and software.

Also, in some embodiments, a product including a processor-readable medium may be provided. The medium stores a set of instructions, an execution of which will cause a method to be performed by an electronic device (e.g., the electronic device 104/200), wherein the method includes: electronically obtaining, by an input, first information relating to a request for establishing communication between a fitting device and an end user device, the end user device being configured to configure a hearing device based on fitting data from the fitting device; electronically processing, by a processing unit, the first information to provide second information for transmission to an AV provider; obtaining, by the processing unit, a connection information associated with a virtual fitting room from the AV provider; providing, by the processing unit, the connection information associated with the virtual fitting room to the fitting device; and providing, by the processing unit, the connection information associated with the virtual fitting room for transmission to the end user device.

In addition, in some embodiments, a product including a processor-readable medium may be provided. The medium stores a set of instructions, an execution of which will cause a method to be performed by an end user device (e.g., the end user device 112/300), wherein the method includes: receiving, by a first communication device, a connection information; operating, by a processing unit, the first communication device to communicatively connect the end user device with a fitting device through a virtual fitting room based on the connection information; and electronically obtaining, by the processing unit, fitting data from the fitting device; wherein the end user device is configured to configure a hearing device based on the fitting data.

Furthermore, in some embodiments, a product including a processor-readable medium may be provided. The medium stores a set of instructions, an execution of which will cause a method to be performed by a fitting device (e.g., the fitting device 106/400), wherein the method includes: obtaining, a user input by a user input component; electronically generating, by a processing unit, first information based on the user input; providing, by the processing unit, the first information for transmission to an electronic device, the first information relating to a request for establishing communication between the fitting device and an end user device, the end user device being configured to configure a hearing device; obtaining, by the processing unit, a connection information associated with a virtual fitting room from the electronic device; communicatively connecting with the virtual fitting room based on the connection information; and communicating with the end user device via the virtual fitting room.

Specialized Processing System

Figure 10:
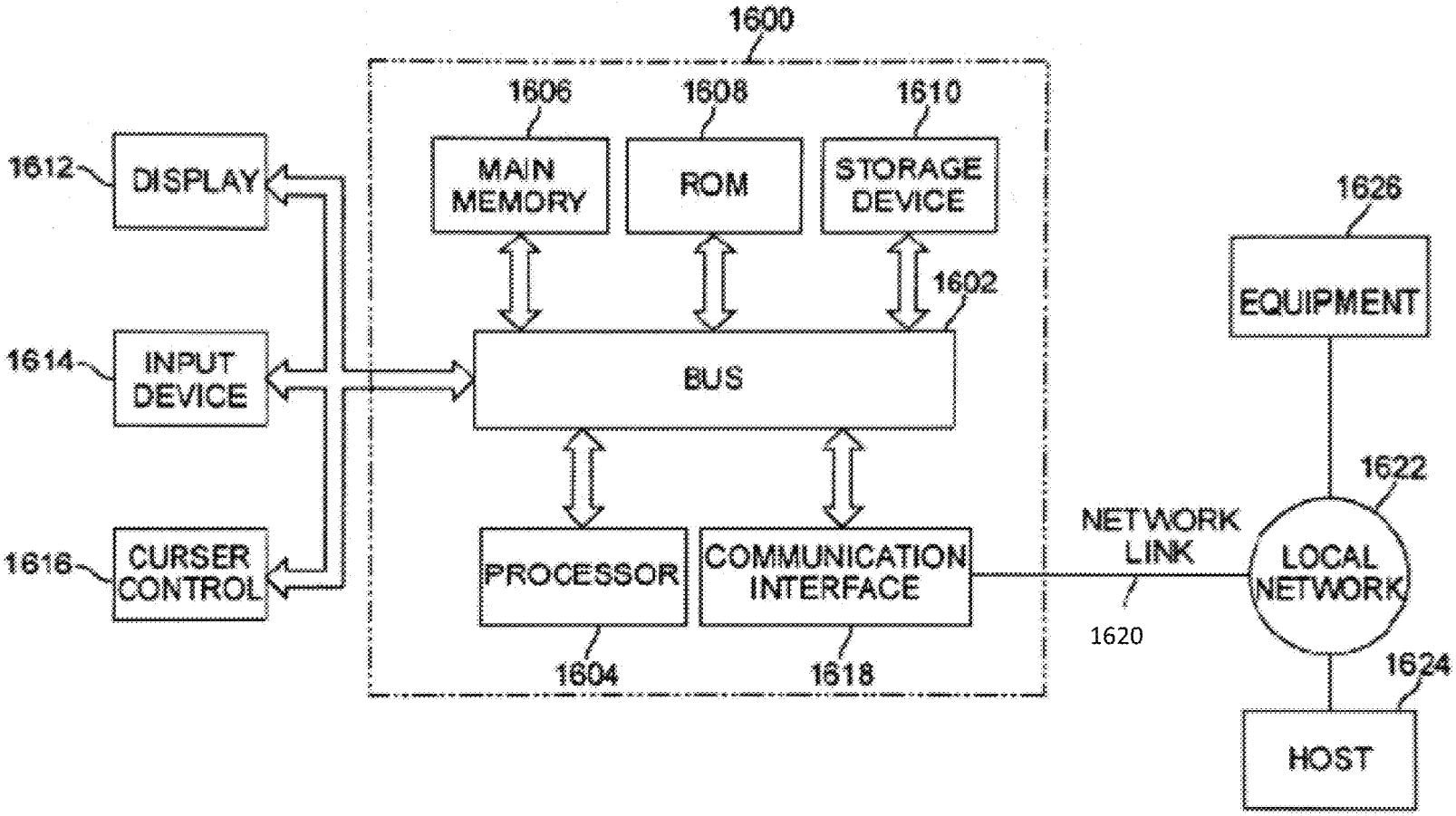
FIG. 10 illustrates a specialized processing system for implementing one or more electronic devices described herein.

FIG. 10 illustrates a specialized processing system for implementing one or more electronic devices described herein. For examples, the processing system 1600 may implement the electronic device 104/200 or at least a part of the electronic device 104/200, the end user device 112/300 or at least a part of the end user device 112/300, or the fitting device 106/400 or at least a part of the fitting device 106/400. In some embodiments, the processing system 1600 may implement the processing unit 204 of the electronic device 200, or the processing unit 304 of the end user device 300, or the processing unit 404 of the fitting device.

Processing system 1600 includes a bus 1602 or other communication mechanism for communicating information, and a processor 1604 coupled with the bus 1602 for processing information. The processing system 1600 also includes a main memory 1606, such as a random access memory (RAM) or other dynamic storage device, coupled to the bus 1602 for storing information and instructions to be executed by the processor 1604. The main memory 1606 also may be used for storing temporary variables or other intermediate information during execution of instructions to be executed by the processor 1604. The processing system 1600 further includes a read only memory (ROM) 1608 or other static storage device coupled to the bus 1602 for storing static information and instructions for the processor 1604. A data storage device 1610, such as a magnetic disk or optical disk, is provided and coupled to the bus 1602 for storing information and instructions.

The processing system 1600 may be coupled via the bus 1602 to a display 167, such as a screen or a flat panel, for displaying information to a user. An input device 1614, including alphanumeric and other keys, or a touchscreen, is coupled to the bus 1602 for communicating information and command selections to processor 1604. Another type of user input device is cursor control 1616, such as a mouse, a trackball, or cursor direction keys for communicating direction information and command selections to processor 1604 and for controlling cursor movement on display 167. This input device typically has two degrees of freedom in two axes, a first axis (e.g., x) and a second axis (e.g., y), that allows the device to specify positions in a plane.

In some embodiments, the processing system 1600 can be used to perform various functions described herein. According to some embodiments, such use is provided by processing system 1600 in response to processor 1604 executing one or more sequences of one or more instructions contained in the main memory 1606. Those skilled in the art will know how to prepare such instructions based on the functions and methods described herein. Such instructions may be read into the main memory 1606 from another processor-readable medium, such as storage device 1610. Execution of the sequences of instructions contained in the main memory 1606 causes the processor 1604 to perform the process steps described herein. One or more processors in a multi-processing arrangement may also be employed to execute the sequences of instructions contained in the main memory 1606. In alternative embodiments, hard-wired circuitry may be used in place of or in combination with software instructions to implement the various embodiments described herein. Thus, embodiments are not limited to any specific combination of hardware circuitry and software.

The term "processor-readable medium" as used herein refers to any medium that participates in providing instructions to the processor 1604 for execution. Such a medium may take many forms, including but not limited to, non-volatile media, volatile media, and transmission media. Non-volatile media includes, for example, optical or magnetic disks, such as the storage device 1610. A non-volatile medium may be considered an example of non-transitory medium. Volatile media includes dynamic memory, such as the main memory 1606. A volatile medium may be considered an example of non-transitory medium. Transmission media includes coaxial cables, copper wire and fiber optics, including the wires that comprise the bus 1602. Transmission media can also take the form of acoustic or light waves, such as those generated during radio wave and infrared data communications.

Common forms of processor-readable media include, for example, a floppy disk, a flexible disk, hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a processor can read.

Various forms of processor-readable media may be involved in carrying one or more sequences of one or more instructions to the processor 1604 for execution. For example, the instructions may initially be carried on a magnetic disk of a remote computer. The remote computer can load the instructions into its dynamic memory and send the instructions over a network, such as the Internet or a local network. A receiving unit local to the processing system 1600 can receive the data from the network, and provide the data on the bus 1602. The bus 1602 carries the data to the main memory 1606, from which the processor 1604 retrieves and executes the instructions. The instructions received by the main memory 1606 may optionally be stored on the storage device 1610 either before or after execution by the processor 1604.

The processing system 1600 also includes a communication interface 1618 coupled to the bus 1602. The communication interface 1618 provides a two-way data communication coupling to a network link 1620 that is connected to a local network 1622. For example, the communication interface 1618 may be an integrated services digital network (ISDN) card or a modem to provide a data communication connection to a corresponding type of telephone line. As another example, the communication interface 1618 may be a local area network (LAN) card to provide a data communication connection to a compatible LAN. Wireless links may also be implemented. In any such implementation, the communication interface 1618 sends and receives electrical, electromagnetic or optical signals that carry data streams representing various types of information.

The network link 1620 typically provides data communication through one or more networks to other devices. For example, the network link 1620 may provide a connection through local network 1622 to a host computer 1624 or to equipment 1626. The data streams transported over the network link 1620 can comprise electrical, electromagnetic or optical signals. The signals through the various networks and the signals on the network link 1620 and through the communication interface 1618, which carry data to and from the processing system 1600, are exemplary forms of carrier waves transporting the information. The processing system 1600 can send messages and receive data, including program code, through the network(s), the network link 1620, and the communication interface 1618.

In one or more embodiments described herein, the hearing device 140 is described as being "configured" by the fitting device 106 and/or the end user device 112. It should be noted that the term "configure the hearing device", or any of other similar terms, may refer to any function or action performed by any entity (e.g., the fitting device 106, the end user device 112, the hearing device 140, etc.) that will cause a change in the hearing device 140. Such function or action includes, and is not limited to, data transmission, data processing, etc. Also, in some embodiments, the hearing device 140 is considered as being "configured" by another entity if the hearing device 140 results in any change. Such change includes, and is not limited to, a change in a processing parameter in the hearing device 140, a change in a processing algorithm in the hearing device 140, a change in a state of the processing unit in the hearing device 140, a change in the content (e.g., data) stored in the memory of the hearing device 140, a change in a functionality of the hearing device 140, etc.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

What is claimed:

1. An electronic device comprising:

an input configured to electronically obtain first information relating to a request for establishing communication between a fitting device and an end user device, the end user device being configured to configure a hearing device based on fitting data from the fitting device; and a processing unit configured to electronically process the first information, and provide second information for transmission to an AV provider;

wherein the processing unit is also configured to obtain a connection information associated with a virtual fitting room from the AV provider, and provide the connection information associated with the virtual fitting room for the fitting device; and wherein the processing unit is also configured to provide the connection information associated with the virtual fitting room for transmission to the end user device.

2. The electronic device of claim 1, wherein the connection information associated with the virtual fitting room is configured to allow the fitting device and the end user device to communicatively connect with each other.

3. The electronic device of claim 1, wherein the first information comprises a request for the connection information, a request to set up a virtual meeting, a request for a session, a request for handshake, or a request that will lead to an establishment of a communication bridge between the fitting device and the end user device.

4. The electronic device of claim 1, wherein the second information comprises a request for the connection information, a request to set up a virtual meeting, a request for a session, a request for handshake, or a request that will lead to an establishment of a communication bridge between the fitting device and the end user device.

5. The electronic device of claim 1, wherein the second information is the same as the first information.

6. The electronic device of claim 1, wherein the connection information comprises a virtual fitting room identification.

7. The electronic device of claim 6, wherein the processing unit is also configured to obtain a first caller identification for the fitting device and a second caller identification for the end user device.

8. The electronic device of claim 7, wherein the processing unit is also configured to provide the first caller identification for transmission to the fitting device, and to provide the second caller identification for transmission to the end user device.

9. The electronic device of claim 1, wherein the electronic device comprises a server that is configured to communicate with the fitting device, the AV provider, and a notification server that is configured to provide VoIP message for the end user device.

10. An end user device comprising:

a first communication device configured to receive a connection information;

a processing unit configured to operate the first communication device to communicatively connect the end user device with a fitting device through a virtual fitting room based on the connection information; and a user input component coupled to the processing unit, wherein the user input component is configured to receive a user input;

wherein the processing unit is also configured to electronically obtain fitting data from the fitting device, and wherein the end user device is configured to configure a hearing device based on the fitting data.

11. The end user device of claim 10, further comprising a second communication device configured to communicate with the hearing device, wherein the processing unit is configured to configure the hearing device via the second communication device.

12. The end user device of claim 10, wherein the end user device is configured to receive data from the fitting device via a chat channel of the virtual fitting room.

13. The end user device of claim 12, wherein the processing unit comprises an interpreter; and wherein the processing unit is configured to electronically obtain the data from the fitting device via the chat channel, and wherein the interpreter is configured to determine whether data is fitting data.

14. The end user device of claim 10, wherein the end user device is configured to configure the hearing device based on the fitting data by transmitting the fitting data to the hearing device.

15. The end user device of claim 10, wherein the connection information comprises a virtual fitting room identification, and wherein the end user device is also configured to obtain a caller identification associated with the end user device, and wherein the processing unit is configured to operate the first communication device to communicatively connect the end user device with the fitting device through the virtual fitting room based on both the virtual fitting room identification and the caller identification.

16. The end user device of claim 15, wherein the end user device is configured to receive the connection information from a notification server.

17. The end user device of claim 16, wherein the connection information is a part of a VoIP message provided by the notification server.

18. The end user device of claim 10, wherein the fitting data comprises hearing aid fitting data.

19. The end user device of claim 10, wherein the end user device comprises a cellular phone, a tablet, a computer, a laptop, a handheld device, or a remote control.

20. A fitting device comprising:

a user input component configured to obtain a user input; and a processing unit configured to electronically generate first information based on the user input, and to provide the first information for transmission to an electronic device, the first information relating to a request for establishing communication between the fitting device and an end user device, the end user device being configured to configure a hearing device;

wherein the processing unit is also configured to obtain a connection information associated with a virtual fitting room from the electronic device; and wherein the fitting device is configured to communicatively connect with the virtual fitting room based on the connection information, and to communicate with the end user device via the virtual fitting room.

21. The fitting device of claim 20, wherein the fitting device is configured to communicate with the end user device via a chat channel of the virtual fitting room.

22. The fitting device of claim 21, wherein the processing unit is configured to provide fitting data for transmission to the end user device via the chat channel.

23. The fitting device of claim 22, wherein the fitting data comprises hearing aid fitting data.

24. The fitting device of claim 22, wherein the processing unit is also configured to generate a control signal for transmission via the chat channel, wherein the control signal is configured to cause the end user device to configure the hearing device.

25. The fitting device of claim 20, wherein the connection information comprises a virtual fitting room identification, and wherein the fitting device is configured to obtain a caller identification associated with the fitting device, and wherein the processing unit is configured to operate the communication device to communicatively connect the fitting device with the end user device through the virtual fitting room based on both the virtual fitting room identification and the caller identification.

26. A hearing system comprising:

an electronic device;

a fitting device; and an end user device, wherein the end user device is configured to configure a hearing device;

(1) wherein the electronic device comprises:

an input configured to electronically obtain first information relating to a request for establishing communication between the fitting device and the end user device, the end user device being configured to configure the hearing device based on fitting data from the fitting device; and a first processing unit configured to electronically process the first information, and provide second information for transmission to an AV provider;

wherein the first processing unit is also configured to obtain a connection information associated with a virtual fitting room from the AV provider, and provide the connection information associated with the virtual fitting room for the fitting device; and wherein the first processing unit is also configured to provide the connection information associated with the virtual fitting room for transmission to the end user device;

(2) wherein the end user device comprises:

a communication device configured to receive the connection information;

a second processing unit configured to operate the communication device to communicatively connect the end user device with the fitting device through the virtual fitting room based on the connection information; and an end-user-device user input component coupled to the second processing unit;

wherein the second processing unit is also configured to electronically obtain the fitting data from the fitting device, and wherein the end user device is configured to configure the hearing device based on the fitting data; and (3) wherein the fitting device comprises:

a fitting-device user input component configured to obtain a user input; and a third processing unit configured to electronically generate the first information based on the user input, and to provide the first information for transmission to the electronic device, the first information relating to the request for establishing communication between the fitting device and the end user device, the end user device being configured to configure the hearing device;

wherein the third processing unit is also configured to obtain the connection information associated with the virtual fitting room from the electronic device; and wherein the fitting device is configured to communicatively connect with the virtual fitting room based on the connection information, and to communicate with the end user device via the virtual fitting room.

* * * * *